US010590643B2

(12) United States Patent
Parkes et al.

(10) Patent No.: US 10,590,643 B2
(45) Date of Patent: Mar. 17, 2020

(54) LOAD TRANSFER PLATE AND LOAD TRANSFER PLATE POCKET AND METHOD OF EMPLOYING SAME

(71) Applicant: Illinois Tool Works Inc., Glenview, IL (US)

(72) Inventors: Nigel K. Parkes, Atlanta, GA (US); Robert U. Connell, Melbourne (AU); David Graham Barnes, Carindale (AU); Nicholas Francis Jolly, Wynnum West (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/809,343

(22) Filed: Nov. 10, 2017

(65) Prior Publication Data

US 2018/0135297 A1 May 17, 2018

Related U.S. Application Data

(60) Provisional application No. 62/422,947, filed on Nov. 16, 2016.

(51) Int. Cl.

| | |
|---|---|
| ***E01C 11/14*** | (2006.01) |
| ***E04B 1/41*** | (2006.01) |
| ***E04B 1/48*** | (2006.01) |
| *E04B 5/32* | (2006.01) |

(52) U.S. Cl.

CPC ..... *E04B 1/4114* (2013.01); *E01C 11/14* (2013.01); *E04B 1/483* (2013.01); *E04B 2005/324* (2013.01)

(58) Field of Classification Search

CPC ..... E01C 11/14; E04B 1/483; E04B 1/4114

See application file for complete search history.

(56) References Cited

U.S. PATENT DOCUMENTS

| | | | |
|---|---|---|---|
| 2,094,853 | A | 10/1937 | Shaw |
| 2,181,005 | A | 11/1939 | Westcott |
| 2,316,233 | A | 4/1943 | Fischer |
| 2,349,983 | A | 5/1944 | Musall |
| 2,654,297 | A | 10/1953 | Nettleton |

(Continued)

FOREIGN PATENT DOCUMENTS

| | | |
|---|---|---|
| CA | 2 712 305 | 7/2009 |
| DE | 10 2007 020 816 | 10/2008 |

(Continued)

OTHER PUBLICATIONS

International Search Report and Written Opinion for International Application No. PCT/US2017/061526, dated Mar. 9, 2018 (18 pages).

(Continued)

*Primary Examiner* — Andrew J Triggs

(74) *Attorney, Agent, or Firm* — Neal, Gerber & Eisenberg LLP

(57) ABSTRACT

Various embodiments of the present disclosure provide a load transfer plate and load transfer plate pocket that co-act to transfer vertical or substantially vertical loads from one concrete slab to the adjacent slab in an enhanced manner by optimizing the positions of the load transfer plate relative to the adjacent concrete slabs for load transfers between the adjacent concrete slabs.

13 Claims, 19 Drawing Sheets

(56) References Cited

U.S. PATENT DOCUMENTS

| | | | | |
|---|---|---|---|---|
| 3,559,541 | A | 2/1971 | Watstein | |
| 4,733,513 | A | 3/1988 | Schrader et al. | |
| 4,942,912 | A | 7/1990 | Gakhar et al. | |
| 5,005,331 | A | 4/1991 | Shaw et al. | |
| 5,216,862 | A | 6/1993 | Shaw et al. | |
| 5,458,433 | A | 10/1995 | Stastny | |
| 5,487,249 | A | 1/1996 | Shaw et al. | |
| 5,730,544 | A | 3/1998 | Dils et al. | |
| 6,019,546 | A | 2/2000 | Ruiz | |
| 6,145,262 | A | 11/2000 | Schrader et al. | |
| 6,354,760 | B1 * | 3/2002 | Boxall | E01C 11/14 404/47 |
| 6,775,952 | B2 | 8/2004 | Boxall et al. | |
| 6,926,463 | B2 | 8/2005 | Shaw et al. | |
| 7,228,666 | B2 | 6/2007 | Michiels | |
| 7,338,230 | B2 | 3/2008 | Shaw et al. | |
| 7,481,031 | B2 | 1/2009 | Boxall et al. | |
| 7,604,432 | B2 * | 10/2009 | Shaw | E01C 19/504 404/58 |
| 7,637,689 | B2 | 12/2009 | Boxall et al. | |
| 7,716,890 | B2 | 5/2010 | Boxall et al. | |
| 7,736,088 | B2 | 6/2010 | Boxall et al. | |
| 8,302,359 | B2 | 11/2012 | Boxall et al. | |
| 8,303,210 | B2 * | 11/2012 | Parkes | E01C 11/14 249/9 |
| 8,356,955 | B2 | 1/2013 | Nadler | |
| 8,381,470 | B2 | 2/2013 | Boxall et al. | |
| 8,573,884 | B2 | 11/2013 | Nadler | |
| 8,627,626 | B2 | 1/2014 | Boxall et al. | |
| 8,672,579 | B2 * | 3/2014 | Laiho | E01C 11/14 404/47 |
| 9,574,309 | B2 | 2/2017 | McDonald | |
| 2006/0275078 | A1 | 12/2006 | Shaw et al. | |
| 2007/0269266 | A1 | 11/2007 | Kelly et al. | |
| 2010/0054858 | A1 * | 3/2010 | Mayo | E01C 11/14 404/56 |
| 2018/0135297 | A1 * | 5/2018 | Parkes | E04B 1/4114 |

FOREIGN PATENT DOCUMENTS

| | | |
|---|---|---|
| FR | 3 043 105 | 5/2017 |
| GB | 2 285 641 | 7/1995 |
| WO | WO 2004/065694 | 8/2004 |
| WO | WO 2005/111332 | 11/2005 |
| WO | WO 2006/123176 | 11/2006 |
| WO | WO 2009/153604 | 12/2009 |
| WO | WO 2010/004294 | 1/2010 |
| WO | WO 2013/128151 | 9/2013 |

OTHER PUBLICATIONS

Diamond Dowel® System Tapered Plate Dowels for Formed Construction Joints brochure, by PNA Construction Technologies, available Jan. 2010 (2 pages).

Diamond™ Dowel Load Transfer System Industrial Slab on Ground brochure, by Danley™ Systems, available Sep. 2016 (8 pages).

Load Transfer Systems Dowel Cradles Industrial Slab on Ground brochure, by ITW Construction Systems and Danley Systems, available prior to Nov. 16, 2016 (12 pages).

* cited by examiner

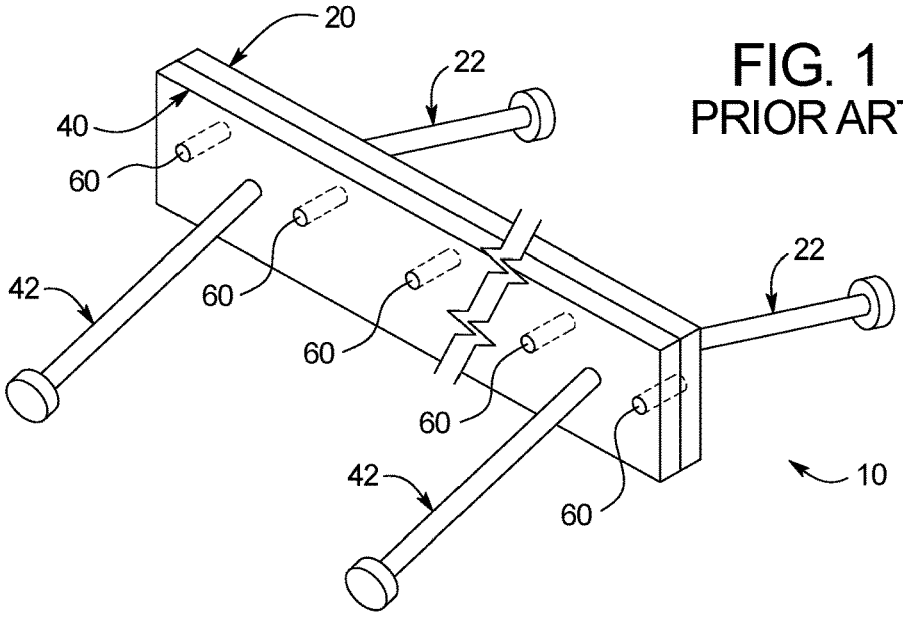
FIG. 1
PRIOR ART
FIG. 2
PRIOR ART
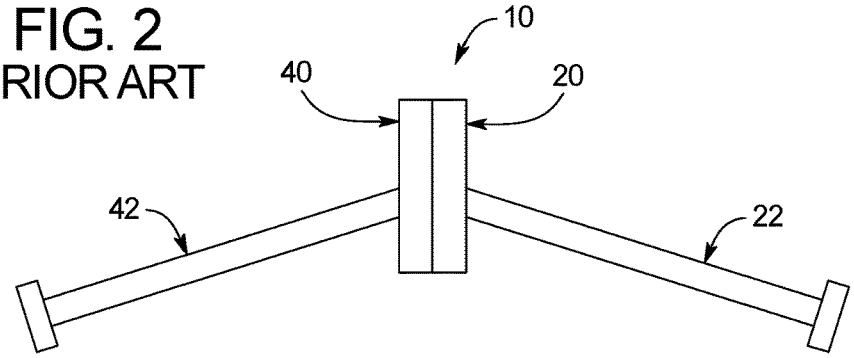
FIG. 3
PRIOR ART
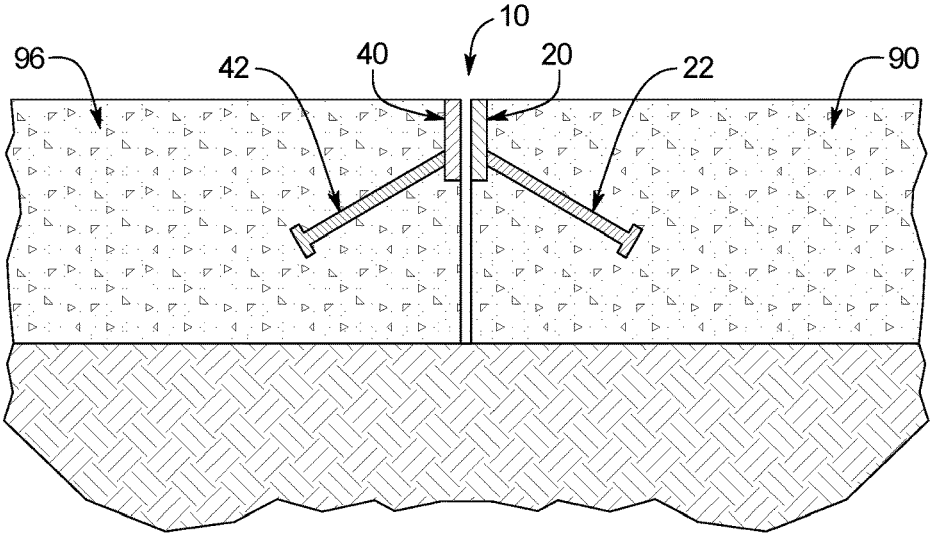

LOAD TRANSFER PLATE AND LOAD TRANSFER PLATE POCKET AND METHOD OF EMPLOYING SAME

PRIORITY

This application claims priority to and the benefit of U.S. Provisional Patent Application Ser. No. 62/422,947, filed Nov. 16, 2017, the entire contents of which are incorporated herein by reference.

BACKGROUND

For various logistical and technical reasons, concrete floors are typically made up of a series of individual cast-in-place concrete blocks or slabs referred to herein as "concrete slabs" or "slabs". These concrete slabs provide several advantages including relief of internal stress due to curing shrinkage and thermal movement. However, there are various known issues with such concrete slabs. These issues often involve the joint between concrete slabs, or the interface where one concrete slab meets another concrete slab.

More specifically, freshly poured concrete shrinks considerably as it cures or hardens due to the chemical reaction that occurs between the cement and water. As the concrete shrinks, tensile stress accumulates in the concrete. Therefore, the joints need to be free to open and thus enable shrinkage of each of the individual concrete slabs without damaging the concrete floor. The joint openings create discontinuities in the concrete floor surface that can cause the wheels of a vehicle (such as a forklift truck) to impact the edges of the adjacent concrete slabs that form the joint and chip small pieces of concrete from the edge of each concrete slab, particularly if the joint edges are not vertically aligned. This damage to the edges of concrete slabs is commonly referred to as joint spalling. Joint spalling can interrupt the normal working operations of a facility by slowing down forklift and other truck traffic, and/or causing damage to trucks and the carried products. Severe joint spalling and uneven joints can cause loaded forklift trucks to overturn (which of course is dangerous to people in those facilities). Joint spalling can also be very expensive and time consuming to repair.

Joint edge assemblies that protect such joints between concrete slabs are widely used in the construction of concrete floors (such as concrete floors in warehouses). Examples of known joint edge assemblies are described in U.S. Pat. Nos. 6,775,952 and 8,302,359. Various known joint edge assemblies enable the joint edges to both self-open with respect to the opposite joint edge as the adjacent concrete slabs shrink during curing or hardening. One known joint edge assembly is generally illustrated in FIGS. 1, 2, and 3. This known joint edge assembly 10 includes two separate elongated joint edge members 20 and 40 temporarily held together by a plurality of connectors 60. The connectors 60 connect the elongated joint edge members 20 and 40 along their lengths during installation. This known joint edge assembly 10 further includes a plurality of anchors 22 that extend from the elongated joint edge member 20 into the region where the concrete of the first concrete slab 90 is to be poured such that, upon hardening of the first concrete slab 90, the anchors 22 are cast within the body of the first concrete slab 90. This known joint edge assembly 10 further includes a plurality of anchors 42 that extend from the elongated joint edge member 40 into the region where the concrete of the second concrete slab 96 is to be poured such that, upon hardening of the second concrete slab 96, the anchors 42 are cast within the body of the concrete slab 96. This known joint edge assembly is positioned such that the ends or edges of the concrete slabs are aligned with the respective outer surfaces of the elongated joint edge members. FIGS. 1 and 2 illustrate the joint edge assembly 10 prior to installation and before the concrete is poured, and FIG. 3 illustrates the joint edge assembly 10 after installation and after the concrete slabs have started shrinking such that the elongated joint edge members 20 and 40 have separated to a certain extent.

Another issue with such joints involves the vertical movements of adjacent concrete slabs relative to each other. The concrete slabs (such as concrete slabs 90 and 96) are preferably configured to move individually, and are also preferably configured with load transferring devices to transfer loads from one concrete slab to the adjacent concrete slab. Transferring loads between adjacent concrete slabs has been accomplished using various different load transferring devices. For example, certain known load transferring devices are in the form of steel dowels or rods and dowel receiving sheaths having circular cross-sections (such as those disclosed in U.S. Pat. Nos. 5,005,331, 5,216,862, and 5,487,249). Other known load transferring devices are in the form of steel dowels or rods and dowel receiving sheaths having rectangular cross-sections (such as those disclosed in U.S. Pat. No. 4,733,513). Such circular and rectangular dowels are capable of transferring loads between adjacent concrete slabs, but have various shortcomings. For example, if such circular or rectangular dowels are misaligned (i.e., not positioned perpendicular to joint), they can undesirably lock the joint together causing unwanted stresses that could lead to slab failure in the form of cracking of the concrete slab. Such misaligned dowels can also restrict movement of the concrete slabs in certain directions. Another shortcoming of such circular and rectangular dowels is that they typically enable the adjacent slabs to move only along the longitudinal axis of the dowel. Another known shortcoming of such circular and rectangular dowels results from the fact that, under a load, only the first 3 to 4 inches of each dowel is typically used for transferring the load from one slab to the adjacent slab. This can create relatively high loadings per square inch at the edge of one or more of the adjacent concrete slabs, which can result in failure of the concrete above or below the dowel.

To solve these problems, load transferring devices such as the dowel and dowel receiving sheath disclosed in U.S. Pat. No. 6,354,760 were developed. These known load transferring devices provide increased relative movement between the adjacent concrete slabs in a direction parallel to the longitudinal axis of the joint and reduce loadings per square inch in the adjacent concrete slabs close to the joint, while transferring loads between the adjacent concrete slabs. These load transferring devices are commercially sold by the assignee of the present application. These load transferring devices have been widely sold and commercially utilized.

In certain circumstances, such as under heavy loads or in relatively thin concrete slabs, it has been found that these load transferring devices do not always move into or remain in or close to the optimal position for load transfer between the adjacent concrete slabs after the adjacent concrete slabs cure. FIGS. 4A, 4B, 5A, and 5B illustrate this issue. FIGS. 4A and 4B show two adjacent cast-in-place concrete slabs 90 and 96 before such concrete slabs 90 and 96 have substantially cured and separated, and with the dowel 70 and the dowel sheath 80 of U.S. Pat. No. 6,354,760. FIGS. 4A and 4B show the dowel 70 positioned half way in the dowel sheath 80 for installation. The central or widest area of the dowel 70 is adjacent to the central plane 98 between the slabs at this point. FIGS. 5A and 5B show a subsequent point in time when the two adjacent cast-in-place concrete slabs 90 and 96 have cured and separated (or have otherwise moved with respect to each other) and that have been formed with the dowel 70 and dowel sheath 80 of U.S. Pat. No. 6,354,760. FIGS. 5A and 5B show the dowel 70 positioned further in concrete slab 96 than in concrete slab 90, and that the central or widest area of the dowel 70 is not positioned along or adjacent to the central plane 98 between the separated concrete slabs 90 and 96. FIGS. 5A and 5B thus show that this known dowel 70 can move relative to both concrete slabs 90 and 96 and can often be positioned offset from the optimal position for load transfer between two adjacent cast-in-place concrete slabs.

In certain circumstances, it has also been found that these known load transferring devices 70 and 80 can cause stress fractures to the concrete slabs or parts of the concrete slabs.

Accordingly, there is a need for improved load transfer devices and methods of using such improved load transfer devices that solve these problems.

SUMMARY

Various embodiments of the present disclosure provide a load transfer apparatus including a load transfer plate and a load transfer plate pocket, and method of employing same that solves the above problems.

Various embodiments of the present disclosure provide a load transfer apparatus including a load transfer plate and a load transfer plate pocket that co-act to transfer vertical or substantially vertical loads from one concrete slab to the adjacent concrete slab in an enhanced manner by optimizing the position of the load transfer plate relative to the adjacent concrete slabs for load transfers between the adjacent concrete slabs.

The present disclosure recognizes that the load transfer plate will generally produce its smallest load per square inch at its widest point. The present disclosure further recognizes that the optimal position for the load transfer plate is thus generally along the vertically extending central plane between the two adjacent concrete slabs. In various embodiments, the load transfer plate and the load transfer plate pocket of the present disclosure are thus configured to cause the load transfer plate to be positioned with its widest area along or as close as possible to the vertically extending central plane between the two concrete slabs. Thus, in various embodiments, the load transfer plate of the present disclosure is self-centering. The load transfer plate and the load transfer plate pocket of the present disclosure are also configured to enable the load transfer plate to move with and as the central plane between the two concrete slabs moves.

Various embodiments of the load transfer plate of the present disclosure include one or more interior edges that define one or more slab attachment openings. These slab attachment openings enable concrete of the second slab to extend through the load transfer plate when the load transfer plate is positioned in the load transfer plate pocket and concrete that forms the second slab is poured. This causes the load transfer plate to be secured or locked to the second concrete slab after this concrete slab cures or hardens. Thus, the load transfer plate moves with the shrinkage of the second concrete slab and also moves with any other subsequent movement of the second concrete slab.

Various embodiments of the present disclosure also provide a load transfer apparatus including a load transfer plate and load transfer plate pocket that minimize stress fractures to the concrete slabs above or below the load transfer plate or load transfer plate pocket.

Various embodiments of the load transfer plate of the present disclosure includes a generally diamond shaped body having: (a) a substantially tapered first half or portion configured to be in the load transfer plate pocket at installation and move with respect to the load transfer plate pocket (that is configured to be secured in the first concrete slab); and (b) a substantially tapered second half or portion configured to be partially in the load transfer pocket at installation and partially protrude into and be secured in the second concrete slab. The body of the load transfer plate includes: (a) a substantially planar upper surface; (b) a substantially planar lower surface; (c) a first stress reducing outer edge; (d) a second stress reducing outer edge; (e) a third stress reducing outer edge; and (f) a fourth stress reducing outer edge.

The stress reducing outer edges are configured to reduce the concentrated stresses that the outer edges of the known load transfer plates place on the portions of the concrete slab when vertical loads are placed on such known load transfer plates. More specifically, the stress reducing outer edges are configured to spread the forces from a single line along the concrete slab to a wider area to reduce the concentrated stresses that the outer edges of the load transfer plates place on the portions of the concrete slab when vertical loads are placed on such known load transfer plates. These stress reducing outer edges additionally increase the amount of vertical load that can be placed on the load transfer plate before the load transfer plate causes a crack in the concrete slab above or below the load transfer plate.

Additional features and advantages of the present invention are described in, and will be apparent from, the following Detailed Description and the Figures.

BRIEF DESCRIPTION OF THE FIGURES

FIG. 1 is a perspective view of a known joint edge assembly.

FIG. 2 is an end view of the known joint edge assembly of FIG. 1.

FIG. 3 is a cross-sectional view of the known joint edge assembly of FIG. 1 shown mounted in two adjacent concrete slabs, and generally illustrating the separation of the two adjacent concrete slabs after they have shrunk to a certain extent.

DETAILED DESCRIPTION OF EXAMPLE EMBODIMENTS

Figure 4A:
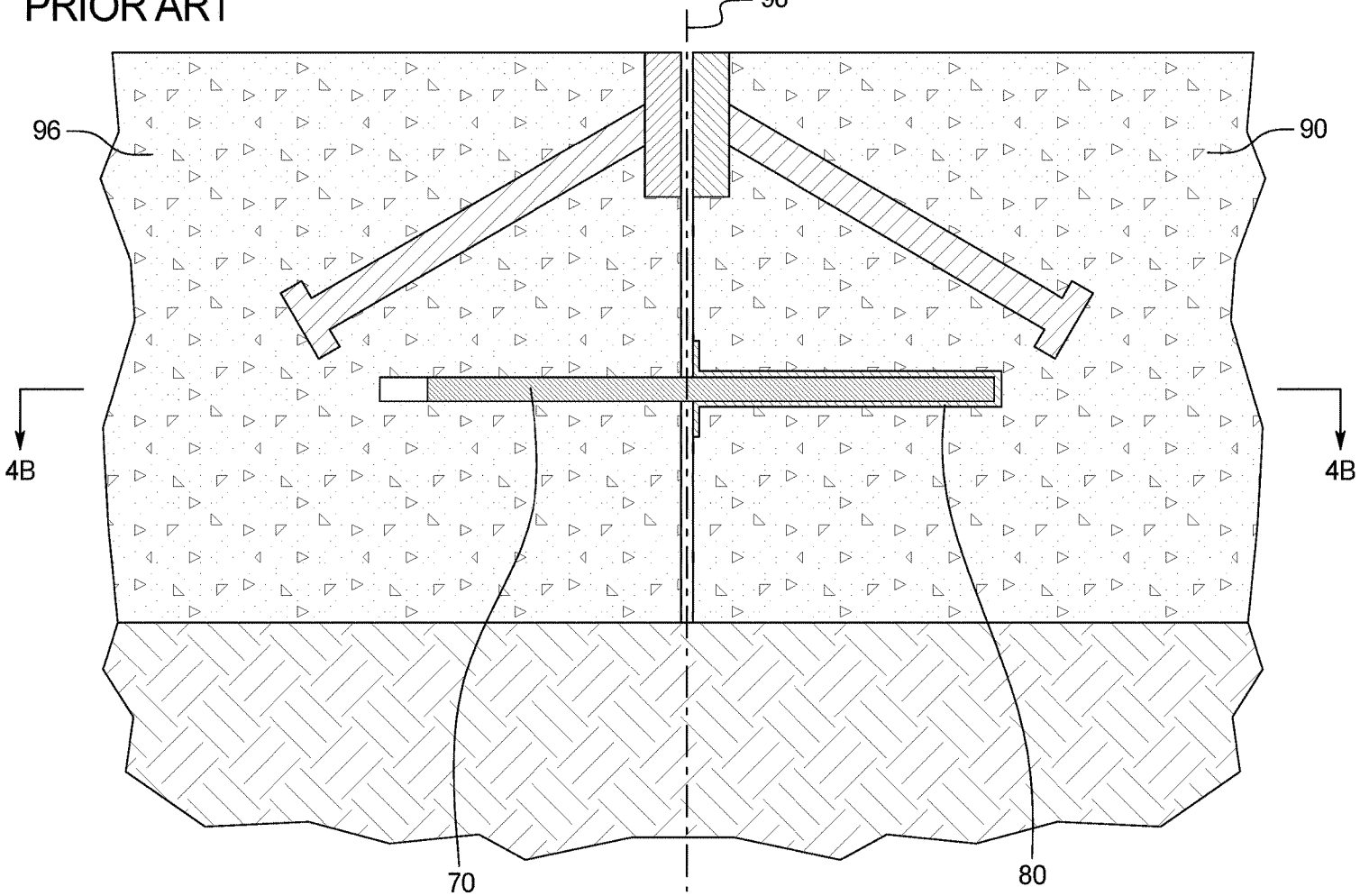
FIG. 4A PRIOR ART
FIGS. 4A and 4B are enlarged side and top cross-sectional views of the known joint edge assembly of FIG. 1 shown mounted in two adjacent concrete slabs, illustrating the separation of the two adjacent concrete slabs after they have shrunk to a certain extent, illustrating a known load transfer plate pocket positioned in the first concrete slab, illustrating a known load transfer plate positioned in the known load transfer plate pocket, and illustrating the initial position of the known load transfer plate during the pouring of the first and second concrete slabs.
Figure 4B:
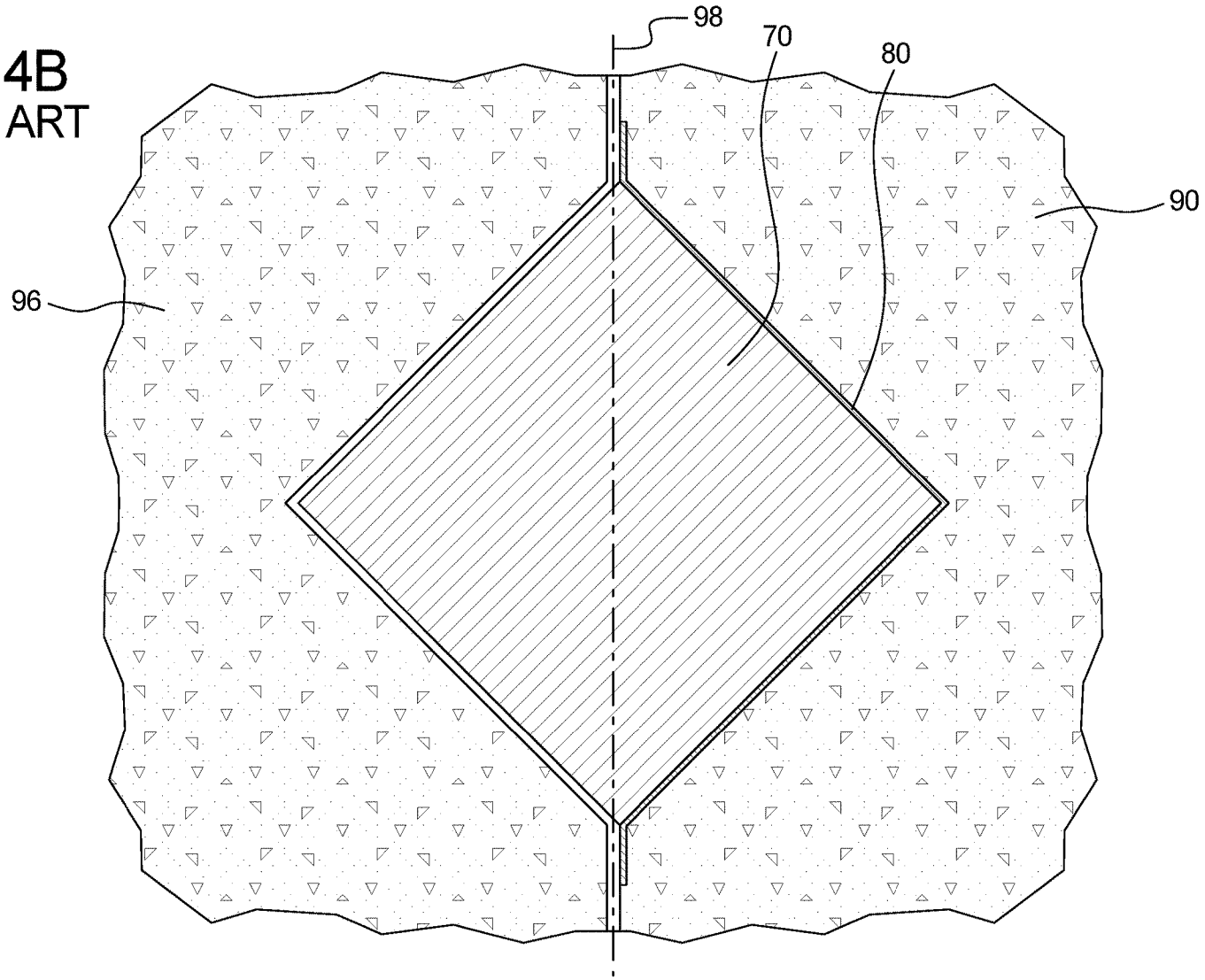
FIG. 4B PRIOR ART
Figure 5A:
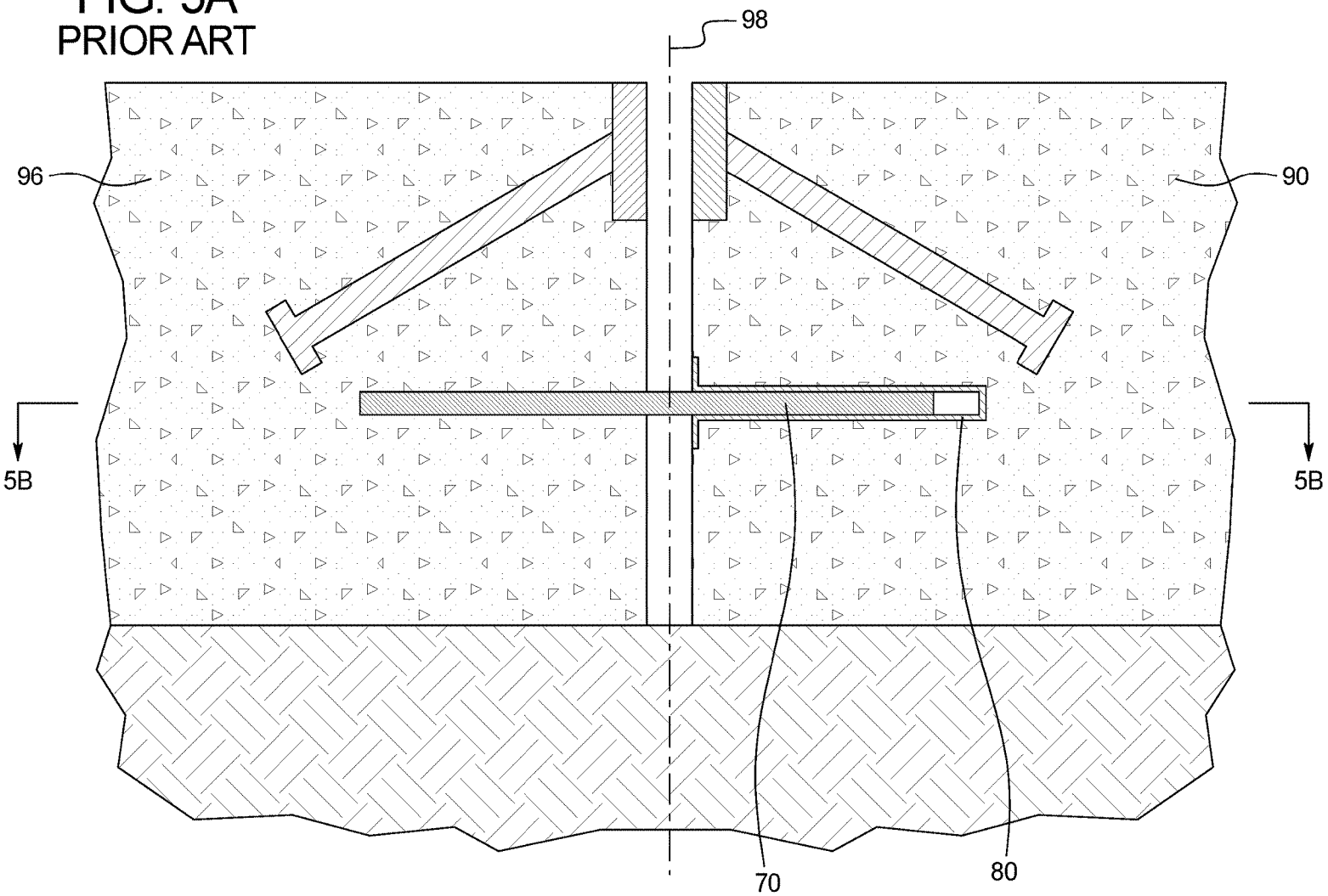
FIG. 5A PRIOR ART
FIGS. 5A and 5B are enlarged side and top cross-sectional views of the known joint edge assembly of FIGS. 4A and 4B shown mounted to two adjacent concrete slabs, illustrating the separation of the two adjacent concrete slabs after they have shrunk to a certain extent, illustrating the known load transfer plate at an offset position relative to a central plane extending between the spaced apart concrete slabs.
Figure 5B:
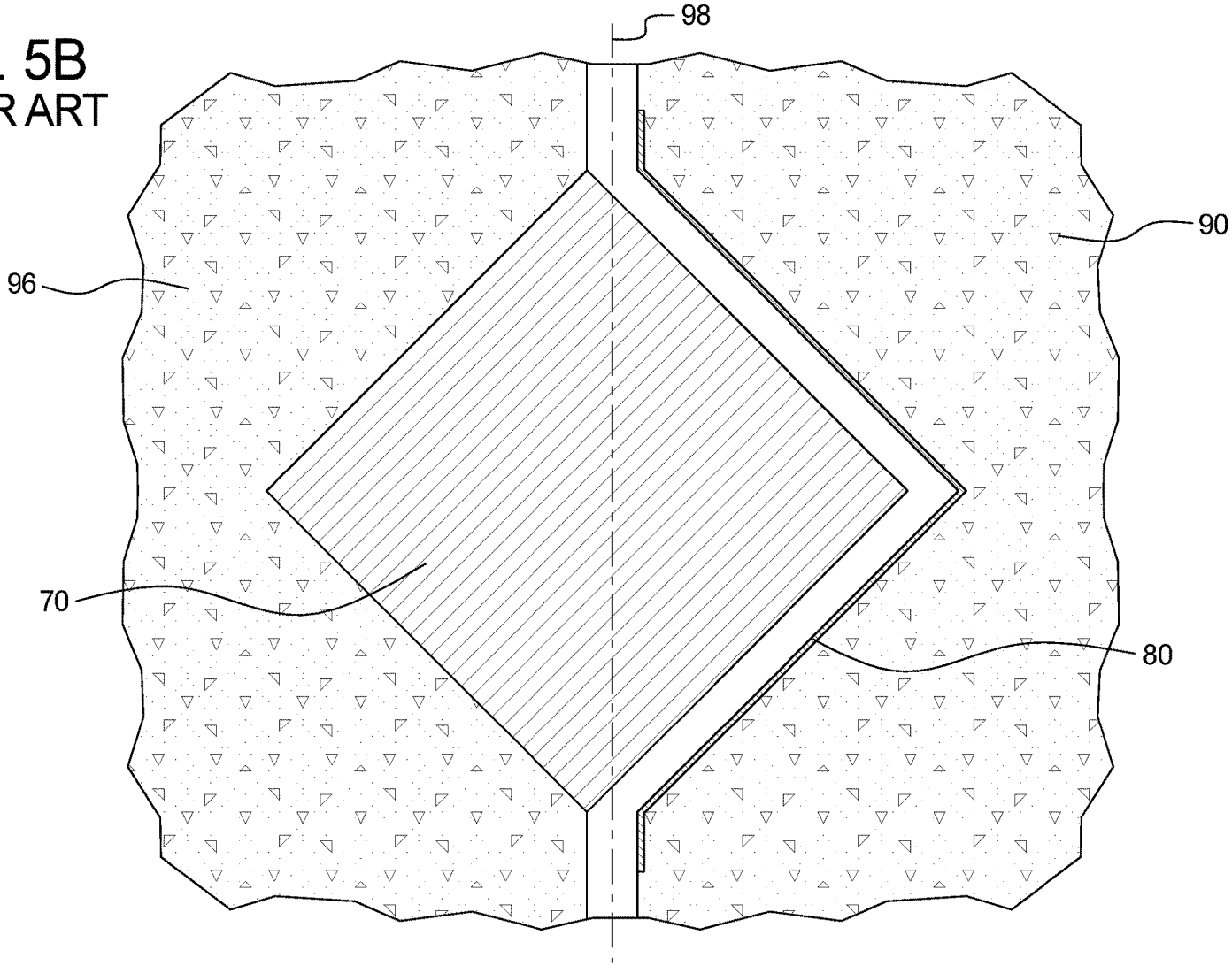
FIG. 5B PRIOR ART

Various embodiments of the present disclosure provide an improved load transfer apparatus including an improved load transfer plate and an improved load transfer plate pocket that solve the above problems. The load transfer apparatus is configured to transfer loads between a first cast-in-place slab (such a first concrete slab) and a second adjacent cast-in-place slab (such as a second concrete slab).

Referring now to FIGS. 6A, 6B, 6C, 7A, 7B, 8A, 8B, 9A, and 9B, one example embodiment of the load transfer plate of the present disclosure is generally indicated by numeral 100, and one example embodiment of the load transfer plate pocket of the present disclosure is generally indicated by numeral 300. FIGS. 8A, 8B, 9A, and 9B also generally partially illustrate one method of employing or installing the load transfer plate pocket 300 and the load transfer plate 100 of the present disclosure in a first cast-in-place slab (such as a first concrete slab 90) and a second cast-in-place slab (such as a second concrete slab 96). It should be appreciated that multiple spaced apart sets of load transfer plate pockets 300 and load transfer plates 100 of the present disclosure will be employed in such adjacent concrete slabs to co-act to transfer vertical or substantially vertical loads from one concrete slab to the adjacent concrete slab in an enhanced manner by optimizing the positions of the load transfer plates 100 relative to the adjacent concrete slabs for load transfer between the adjacent concrete slabs.

In this illustrated example embodiment shown in FIGS. 8A, 8B, 9A, and 9B, concrete slab 90 is poured before concrete slab 96. In this illustrated example embodiment, the load transfer plate pocket 300 is configured to be attached to a conventional form (not shown) before the first concrete slab 90 is poured such that the load transfer plate pocket 300 extends into the first concrete slab 90 and is maintained in the first concrete slab 90 after the first concrete slab 90 is poured and hardened or cured as shown in FIGS. 8A, 8B, 9A, and 9B. The load transfer plate 100 is configured to be inserted in the load transfer plate pocket 300 after (or alternatively before) the first concrete slab 90 is poured, and before the second concrete slab 96 is poured.

It should be appreciated that in an alternative method of the present disclosure, if slab 96 is poured before slab 90, then the load transfer plate pocket 300 would be attached to a form (not shown) before the concrete slab 96 is poured such that the load transfer plate pocket 300 extends into the concrete slab 96 and would be maintained in the concrete slab 96 after the concrete slab 96 is poured and hardened or cured. If concrete slab 96 is poured before concrete slab 90, the load transfer plate 100 would be inserted in the load transfer plate pocket 300 after (or alternatively before) the concrete slab 96 is poured, and before the concrete slab 90 is poured.

In this illustrated example embodiment, the load transfer plate 100 includes a generally diamond shaped body 110 having: (a) a substantially tapered first half or portion 112 configured to protrude into and move with respect to the load transfer plate pocket 300 that is secured in the first concrete slab 90; and (b) a substantially tapered second half or portion 114 configured to be initially partially positioned in the load transfer plate pocket 300 at installation and also protrude into and be secured in the second concrete slab 96. In this illustrated embodiment, the substantially tapered first portion 112 and the substantially tapered second portion 114 are substantially equal in size and shape.

In this illustrated example embodiment, the substantially tapered first portion 112 has a largest width (measured parallel to the longitudinal axis of the joint) at the area of the first portion 112 adjacent to tapered second portion 114, and a smallest width at the point 113. In this illustrated example embodiment, the first portion 112 is uniformly tapered from the area of the first portion 112 adjacent to second portion 114 to the point 113; however, such taper does not have to be uniform in accordance with the present disclosure.

In this illustrated example embodiment, the substantially tapered second portion 114 has a largest width (measured parallel to the longitudinal axis of the joint) at the area of the second portion 114 adjacent to tapered first portion 112, and a smallest width at the point 115. In this illustrated example embodiment, the second portion 114 is uniformly tapered from the area of the second portion 114 adjacent to first portion 112 to the point 115; however, such taper does not have to be uniform in accordance with the present disclosure.

Accordingly, in this illustrated example embodiment, the load transfer plate 100 has its greatest width at the area where the substantially tapered first portion 112 and the substantially tapered second portion 114 meet or connect (i.e., along the center line or plane 116).

In this illustrated example embodiment, the load transfer plate 100 is also relatively wide compared to its thickness or height and has a length to width ratio of approximately 1:1; however, it should be appreciated that the width compared to the thickness or height may vary, and that the length to width ratio may vary in accordance with the present disclosure.

The body 110 of the load transfer plate 100 also generally includes: (a) a substantially planar upper surface 120; (b) a substantially planar lower surface 130; (c) a first stress reducing outer edge 140; (d) a second stress reducing outer edge 150; (e) a third stress reducing outer edge 160; (f) a fourth stress reducing outer edge 170; and (g) an interior edge 180 that defines a slab attachment opening 190.

The first stress reducing outer edge 140 includes: (a) a side edge 142 that extends perpendicular to the upper surface 120 and to the lower surface 130; (b) a top angled edge 144 that extends downwardly at an obtuse angle from the upper surface 120 to the side edge 142, and that extends upwardly at an obtuse angle from the side edge 142 to the upper surface 120; and (c) a bottom angled edge 146 that extends upwardly at an obtuse angle from the lower surface 130 to the side edge 142, and that extends downwardly at an obtuse angle from the side edge 142 to the lower surface 130.

The second stress reducing outer edge 150 includes: (a) a side edge 152 that extends perpendicular to the upper surface 120 and to the lower surface 130; (b) a top angled edge 154 that extends downwardly at an obtuse angle from the upper surface 120 to the side edge 152, and that extends upwardly at an obtuse angle from the side edge 152 to the upper surface 120; and (c) a bottom angled edge 156 that extends upwardly at an obtuse angle from the lower surface 130 to the side edge 152, and that extends downwardly at an obtuse angle from the side edge 152 to the lower surface 130.

The third stress reducing outer edge 160 includes: (a) a side edge 162 that extends perpendicular to the upper surface 120 and to the lower surface 130; (b) a top angled edge 164 that extends downwardly at an obtuse angle from the upper surface 120 to the side edge 162, and that extends upwardly at an obtuse angle from the side edge 162 to the upper surface 120; and (c) a bottom angled edge 166 that extends upwardly at an obtuse angle from the lower surface 130 to the side edge 162, and that extends downwardly at an obtuse angle from the side edge 162 to the lower surface 130.

The fourth stress reducing outer edge 170 includes: (a) a side edge 172 that extends perpendicular to the upper surface 120 and to the lower surface 130; (b) a top angled edge 174 that extends downwardly at an obtuse angle from the upper surface 120 to the side edge 172, and that extends upwardly at an obtuse angle from the side edge 172 to the upper surface 120; and (c) a bottom angled edge 176 that extends upwardly at an obtuse angle from the lower surface 130 to the side edge 172, and that extends downwardly at an obtuse angle from the side edge 172 to the lower surface 130.

In this illustrated example embodiment, the three part multiple angled or chamfered stress reducing outer edges 140, 150, 160, and 170 reduce the concentrated stresses that the outer edges of the load transfer plate 100 place on the portions of the concrete slab when which vertical loads are placed on the load transfer plate 100. More specifically, these three part multiple angled or chamfered stress reducing outer edges 140, 150, 160, and 170 spread the forces from a single line along the concrete slab to a wider area to reduce the concentrated stresses that the outer edges of the load transfer plate 100 place on the portions of the concrete slab when vertical loads are placed on the load transfer plate 100. These three part multiple angled or chamfered stress reducing outer edges 140, 150, 160, and 170 additionally increase the amount of vertical load that can be placed on the load transfer plate 100 before the load transfer plate 100 causes a crack in the concrete slab.

It should be appreciated that in alternative embodiments, less than off of the edges are stress reducing edges.

The load transfer plate 100 additionally includes the interior edge 180 that defines the slab attachment opening 190. This slab attachment opening 190 enables concrete of the second slab 96 to extend through the load transfer plate 100 when the load transfer plate 100 in positioned in the pocket 300 and concrete of the second slab 96 is poured. This causes the load transfer plate 100 to be locked to the second concrete slab 96 after the concrete slab 96 is cured. Thus, in this illustrated example embodiment, the load transfer plate 100 moves with the shrinkage of the second concrete slab 96 and additionally moves with various other lateral movements of the second concrete slab 96. It should be appreciated that the shape of the slab attachment opening may vary in accordance with the present disclosure. It should be appreciated that the quantity of slab attachment openings may vary in accordance with the present disclosure.

This illustrated example embodiment of the load transfer plate pocket 300 includes an attachment wall 310 and a generally triangular shaped body integrally formed and extending from the back or back face of the attachment wall 310. The body 320 of this illustrated example load transfer plate pocket 300 includes: (a) a triangular upper wall 330; (b) a triangular lower wall 340; (c) a first side wall 350; (d) a second side wall 360; (f) a plurality of first load transfer plate positioners 370*a* and 370*b*; (g) a plurality of second load transfer plate positioners 380*a* and 380*b*; (h) a third load transfer plate centering positioner 371*a*; (i) a fourth load transfer plate centering positioner 381*a*.

More specifically, the attachment wall 310 in this illustrated example embodiment includes a generally flat rectangular body 311 that defines: (a) a load transfer plate receiving opening or slot 312; (b) a first fastener opening 313; and (c) a second fastener opening 314. The load transfer plate receiving opening or slot 312 is configured such that the load transfer plate 100 can freely move through the load transfer plate receiving opening or slot 312. The first fastener opening 313 and the second fastener opening 314 are configured to respectively receive fasteners such as nails (not shown) that during installation secure and hold the load transfer plate pocket 300 to the form (not shown) before and during pouring of the first concrete slab 90 such that: (a) the attachment wall 310 extends in the same plane as the outer vertical surface of the first concrete slab 90; and (b) the rest of or the body 320 of the load transfer plate pocket 300 extends into the first concrete slab 90.

The triangular upper wall 330 is integrally formed with and extends from the back or back face of the body 311 of the attachment wall 310 above the load transfer plate receiving opening or slot 312. The triangular lower wall 340 is integrally formed with and extends from the back or back face of the body 311 of the attachment wall 310 below the load transfer plate receiving opening or slot 312. The triangular lower wall 340 is thus spaced apart from the triangular upper wall 330 such that the load transfer plate 100 can freely move between the lower wall 340 and the upper wall 330.

The first side wall 350 is integrally formed with and extends from the back or back face of the body 311 of the attachment wall 310 adjacent to one side of the load transfer plate receiving opening or slot 312. The first side wall 350 is also integrally connected to the triangular upper wall 330. The first side wall 350 is also integrally connected to the triangular lower wall 330.

The second side wall 360 is integrally formed with and extends from the back or back face of body 311 of the attachment wall 310 adjacent to the other side of the load transfer plate receiving opening or slot 312. The second side wall 360 is integrally connected to the triangular upper wall 330. The second side wall 360 is integrally connected to the triangular lower wall 330. The second side wall 360 is integrally formed with and extends the first side wall 350.

Figure 8A:
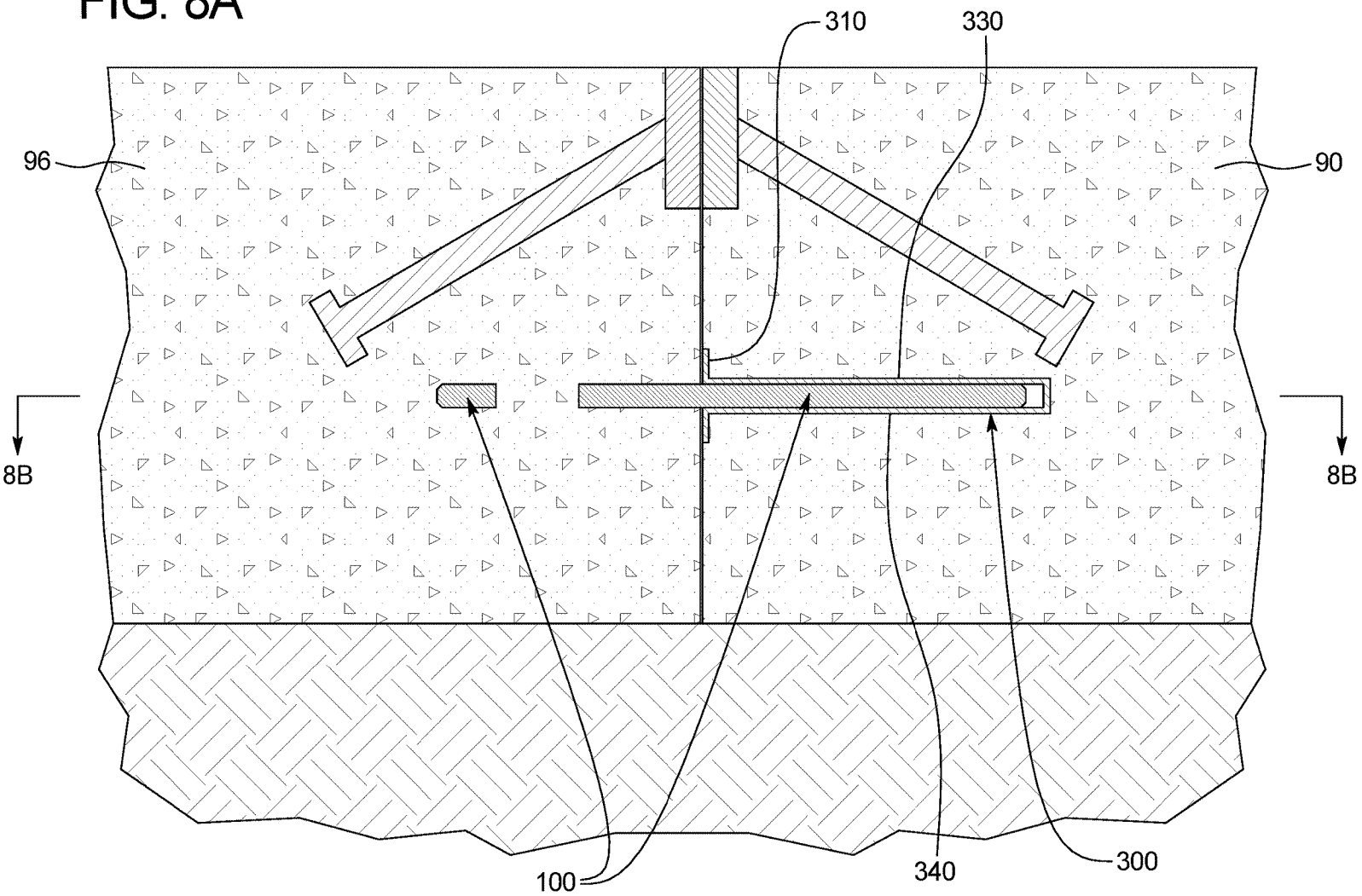
FIGS. 8A and 8B are enlarged side and top cross-sectional views of a joint edge assembly of FIG. 1 shown mounted to two adjacent concrete slabs, illustrating the two adjacent concrete slabs before they have shrunk, illustrating the load transfer plate pocket of FIGS. 7A and 7B positioned in the first concrete slab, and illustrating the load transfer plate of FIG. 6A positioned partially in the load transfer plate pocket and partially in the second concrete slab.
Figure 8B:
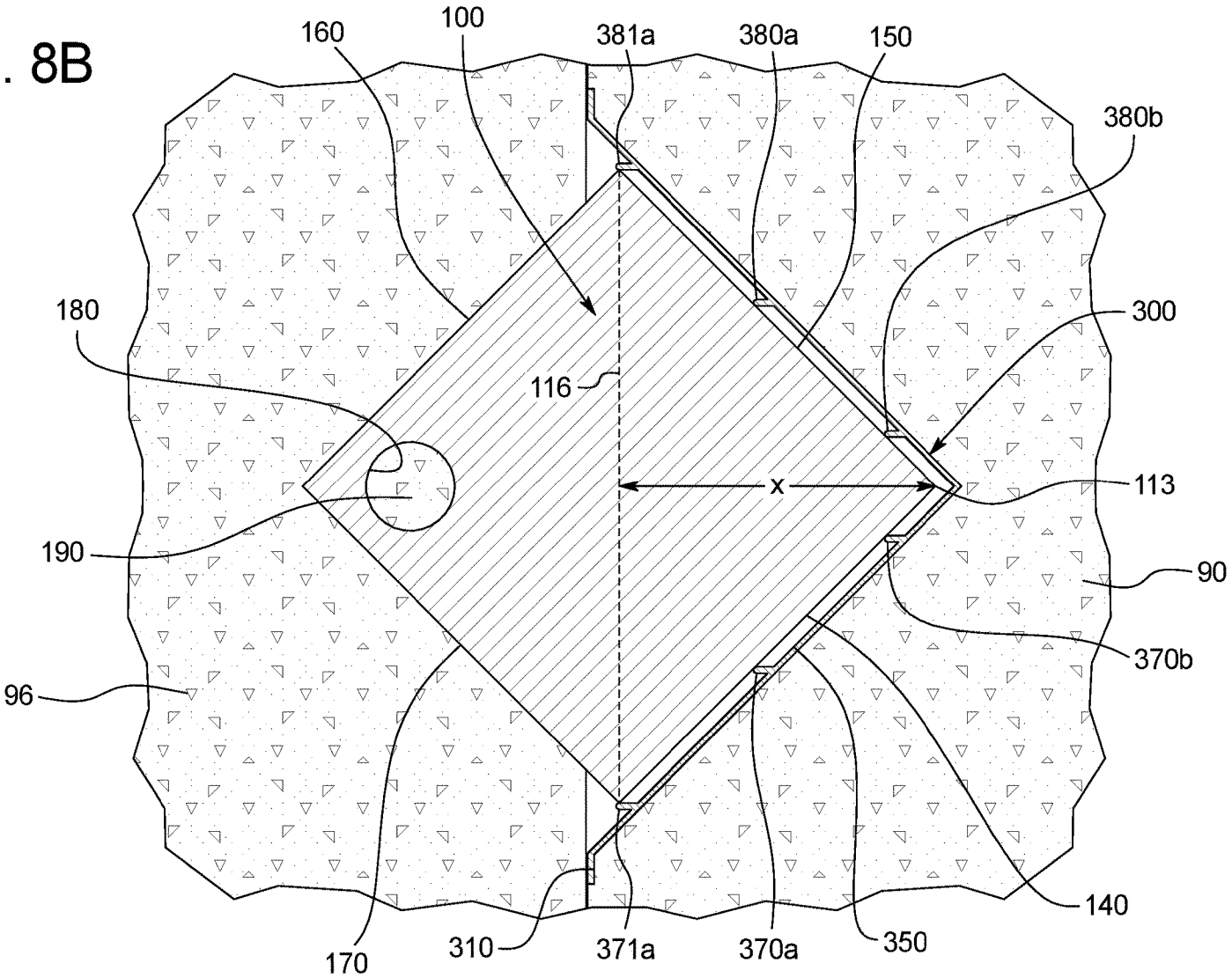

The attachment wall 310, the triangular upper wall 330, the triangular lower wall 340, the first side wall 350, and the second side wall 360 define a load transfer plate receiving chamber or area 308 that in this illustrated example embodiment is configured to receive the entire first half or portion 112 of the load transfer plate 100 and part of the second half or portion 114 of the load transfer plate as generally shown in FIGS. 8A and 8B.

Figure 6A:
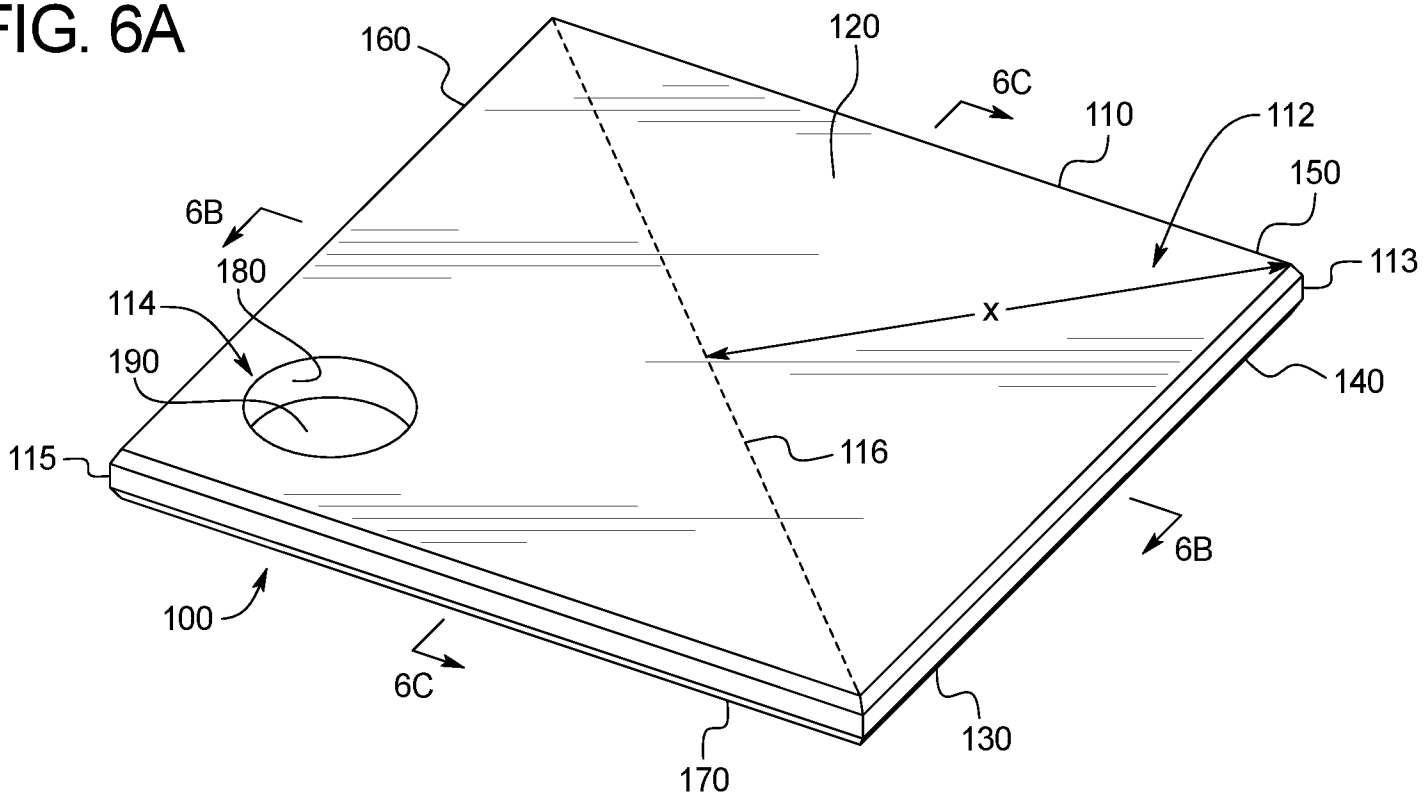
FIG. 6A is a top perspective view of the load transfer plate of one example embodiment of the present disclosure.
Figure 6B:
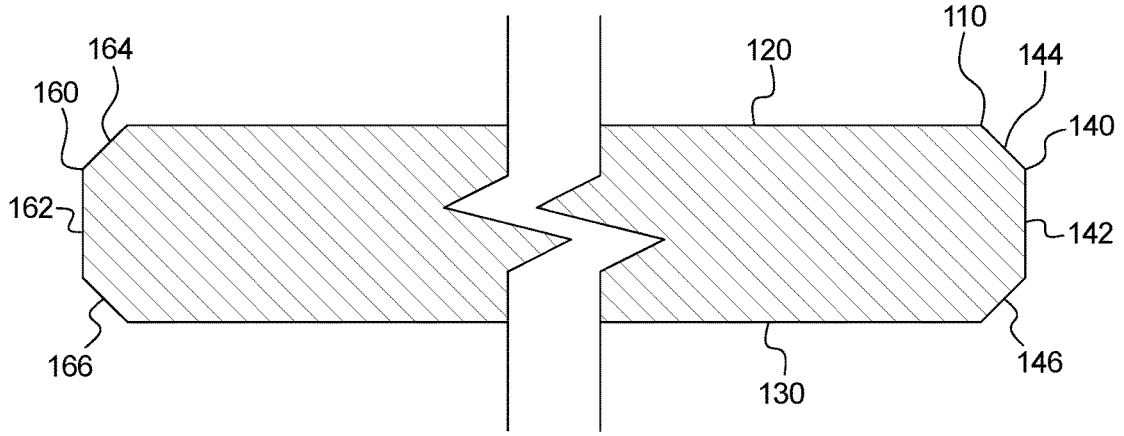
FIG. 6B is an enlarged cross-sectional view of the load transfer plate of FIG. 6A taken substantially along line 6B-6B of FIG. 6A.
Figure 6C:
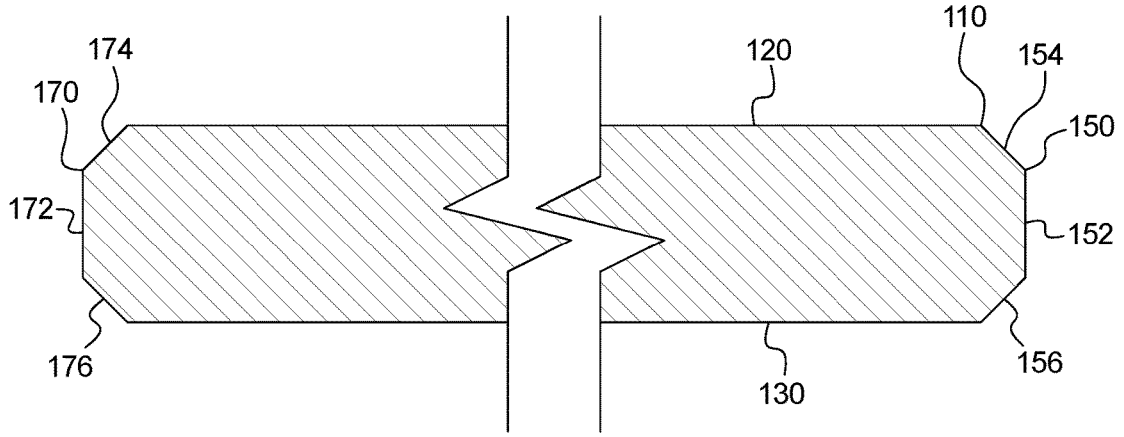
FIG. 6C is an enlarged cross-sectional view of the load transfer plate of FIG. 6A taken substantially along line 6C-6C of FIG. 6A.
Figure 7A:
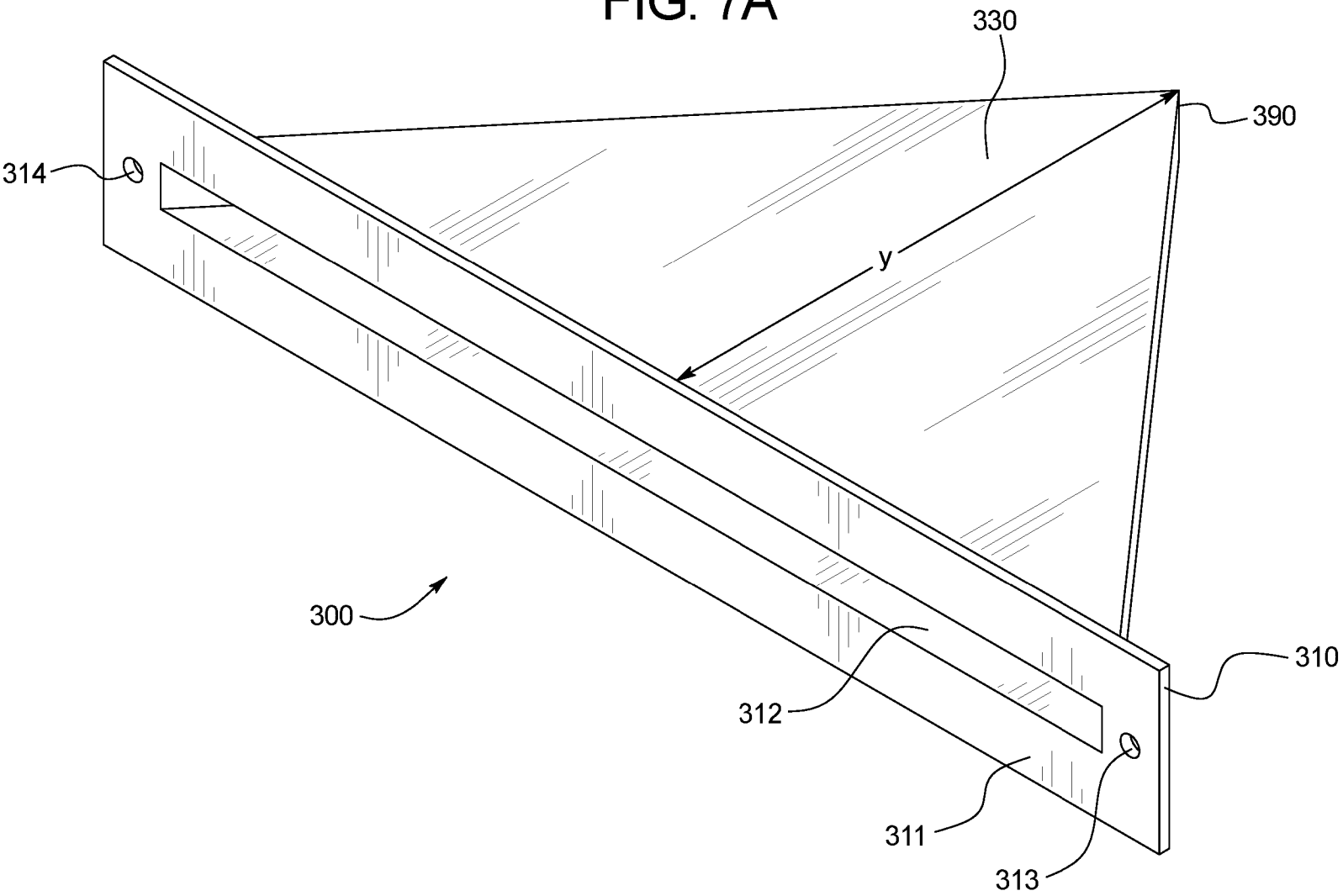
FIG. 7A is a top perspective view of the load transfer plate pocket of one example embodiment of the present disclosure.
Figure 7B:
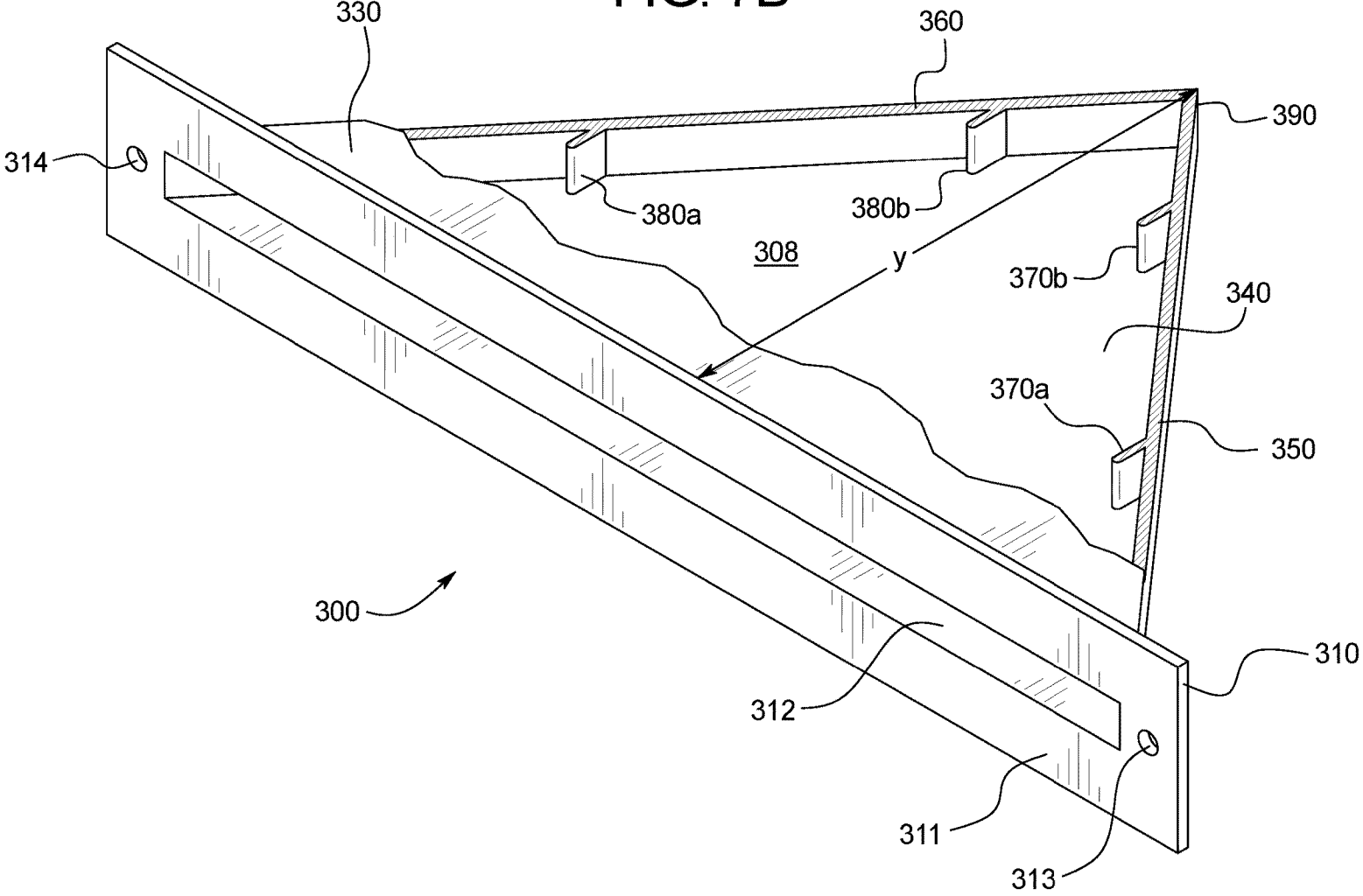
FIG. 7B is a fragmentary top perspective view of the load transfer plate pocket of FIG. 7A, showing interior portions of the load transfer plate pocket.

In this illustrated example embodiment, the width of the load transfer plate receiving chamber or area 308 of the load transfer plate pocket 300 is greater than the width of the substantially tapered end of the load transfer plate 100 at each corresponding depth along the substantially first tapered half or portion 112 of the load transfer plate 100, such that the substantially first tapered half or portion 112 of the load transfer plate 100 and part of the second half or portion 114 of the load transfer plate 100 can be positioned within the load transfer plate pocket 300 in a direction parallel to the upper surface of the first slab 96. In other words, in this illustrated embodiment, the load transfer plate 100 and the load transfer plate pocket 300 are configured and sized such that: (a) the distance X (as shown in FIGS. 6A and 8B) from the point 113 to the center line or plane 116 of the load transfer plate 100 is less than (b) the distance Y (as shown in FIGS. 7A and 7B) from the end point 390 to the attachment wall 310 of the load transfer plate pocket 300. This configuration enables the load transfer plate 100 to be positioned in the load transfer plate pocket 300 beyond the center line or plane 116 of the load transfer plate 100 such as shown in FIGS. 8A and 8B. This larger load transfer plate pocket 300 also allows for heat caused expansion of the load transfer plate 100.

The plurality of first load transfer plate positioners 370*a* and 370*b* are integrally connected to and extend inwardly from the first side wall 350 toward the back face of the attachment wall 310. The plurality of first load transfer plate positioners 370*a* and 370*b* in this illustrated embodiment are flexible and thus bend when the load transfer plate 100 moves further into or expands further into the pocket or area 308 and engages the first load transfer plate positioners 370*a* and 370*b* under sufficient pressure.

Likewise, the plurality of second load transfer plate positioners 380*a* and 380*b* are integrally connected to and extend inwardly from the second side wall 360 toward the back face of the attachment wall 310. The plurality of second load transfer plate positioners 380*a* and 380*b* are flexible and thus bend when the load transfer plate 100 further moves into the pocket or area 308 and engages these first load transfer plate positioners 380*a* and 380*b* under sufficient pressure.

The plurality of load transfer plate positioners 370*a*, 370*b*, 380*a*, and 380*b* thus account for the situation where the concrete slabs are made from a concrete that first expands before it contracts. In such case, the plurality of load transfer plate positioners 370*a*, 370*b*, 380*a*, and 380*b* in this illustrated embodiment allow for such expansion and movement of the load transfer plate 100 further into the load transfer plate pocket 300 (i.e., into the interior void between the plate 100 and pocket 300). The plurality of load transfer plate positioners 370*a*, 370*b*, 380*a*, and 380*b* in this illustrated embodiment also allow for heat expansion of the load transfer plate 100 itself. In certain embodiments, one or more of the load transfer plate positioners 370*a*, 370*b*, 380*a*, and 380*b* can be configured to break off from the walls or walls of the load transfer plate pocket 300. It should be appreciated that the quantity of load transfer plate positioners can vary in accordance with the present disclosure.

The load transfer plate pocket 300 also includes load transfer plate centering positioners 371*a* and 381*a* for initially centering the load transfer plate 100 within the width of the load transfer plate pocket 300 during initial installation of the load transfer plate 100 in the load transfer plate pocket 300. The load transfer plate centering positioners 371*a* and 381*a* are spaced apart such that they engage the opposing side points of the load transfer plate 100. In certain embodiments, the load transfer plate centering positioners 371*a* and 381*a* are configured to engage first and second tips of the load transfer plate, wherein the first and second tips define a widest area of the load transfer plate, as illustrated in FIG. 8B. In various embodiments, these load transfer plate centering positioners 371*a* and 381*a* are configured to break off from the wall or walls of the load transfer plate pocket 300 after initial installation.

In various embodiments the load transfer plate positioners 370*a*, 370*b*, 380*a*, and 380*b* and/or the load transfer plate centering positioners 371*a* and 381*a* can assist in allowing for lateral movements of the load transfer plate 100 in the load transfer plate pocket 300 (such as lateral movements which may occur after shrinkage).

The present disclosure recognizes that the load transfer plate 100 will generally produce its smallest load per square inch at its widest point. The present disclosure further recognizes that the optimal position for the load transfer plate 100 is thus generally along the vertically extending central plane between the two adjacent concrete slabs 90 and 96. The load transfer plate 100 and the load transfer plate pocket 300 of the present disclosure are thus configured to cause the load transfer plate 100 to be positioned with its widest area along or as close as possible to the vertically extending central plane between the two concrete slabs 90 and 96. The load transfer plate 100 and the load transfer plate pocket 300 of the present disclosure are also configured to enable the load transfer plate 100 to move with and as the central plane between the two concrete slabs 90 and 96 moves.

FIGS. 8A, 8B, 9A, and 9B generally illustrate how the load transfer plate 100 and load transfer plate pocket 300 optimize the position of the load transfer plate 100 between the adjacent concrete slabs 90 and 96 during installation and when the adjacent concrete slabs 90 and 96 shrink and have moved away from each other an expected distance during the curing process or otherwise (subsequently to curing).

More specifically, FIGS. 8A and 8B show two adjacent cast-in-place concrete slabs 90 and 96 before such concrete slabs 90 and 96 have substantially cured and separated, and with the load transfer plate 100 positioned in the load transfer plate pocket 300 for installation such that the entire first half or portion 112 of the load transfer plate 100 and part of the second half or portion 114 of the load transfer plate is in the load transfer plate pocket 300. At this point in time, the load transfer plate 100 is not positioned at the optimal position for transferring loads between the two adjacent cast-in-place concrete slabs 90 and 96.

Figure 9A:
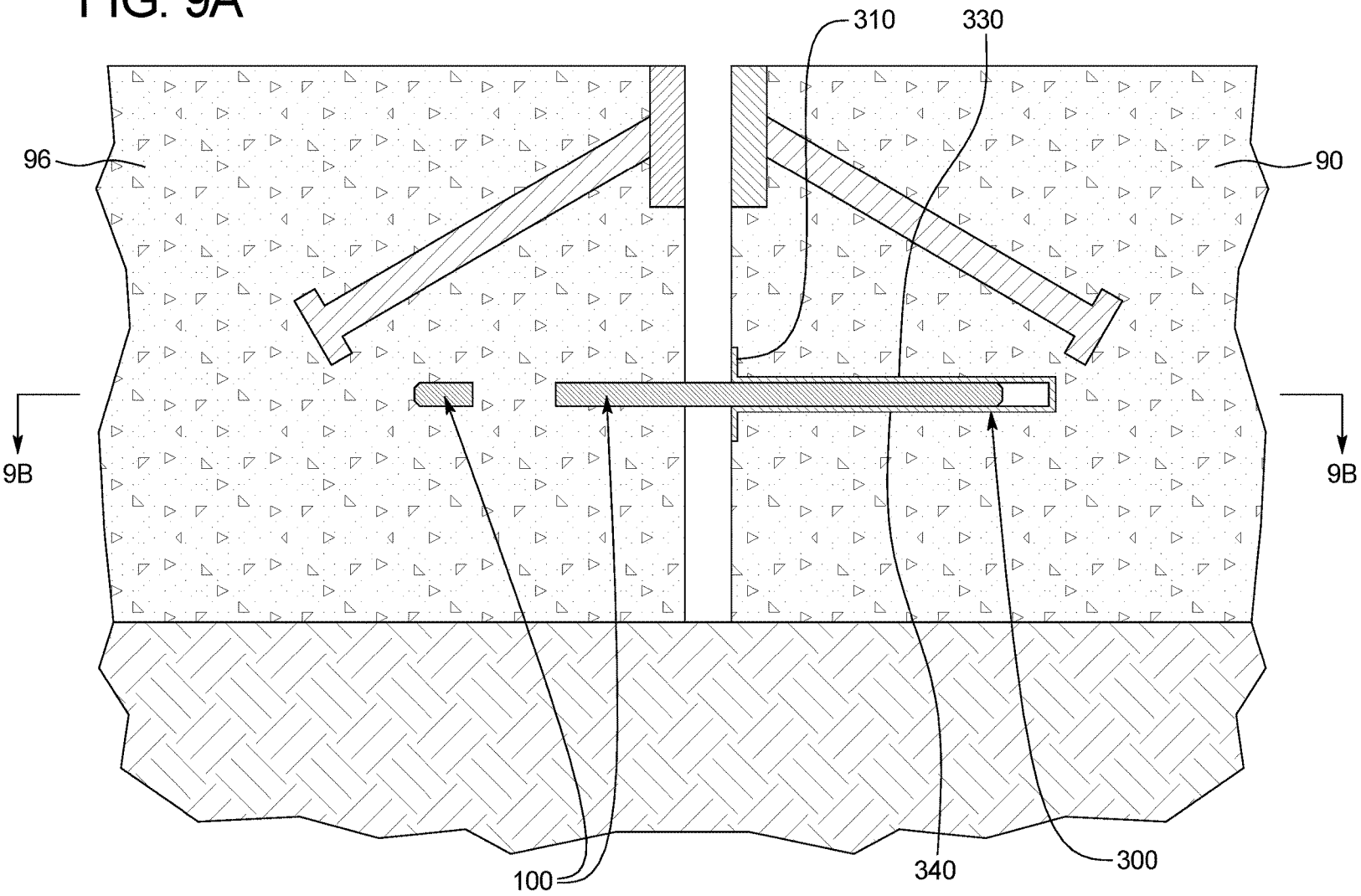
FIGS. 9A and 9B are enlarged side and top cross-sectional views of the joint edge assembly of FIGS. 8A and 8B shown mounted to the two adjacent concrete slabs of FIGS. 8A and 8B, illustrating the two adjacent concrete slabs after they have shrunk and separated to a certain extent, illustrating the load transfer plate pocket of FIGS. 7A and 7B partially positioned in the first concrete slab, and illustrating the load transfer plate of FIG. 6A positioned in the concrete slabs such that a central portion of the load transfer plate extends along the central plane extending between the spaced apart concrete slabs.
Figure 9B:
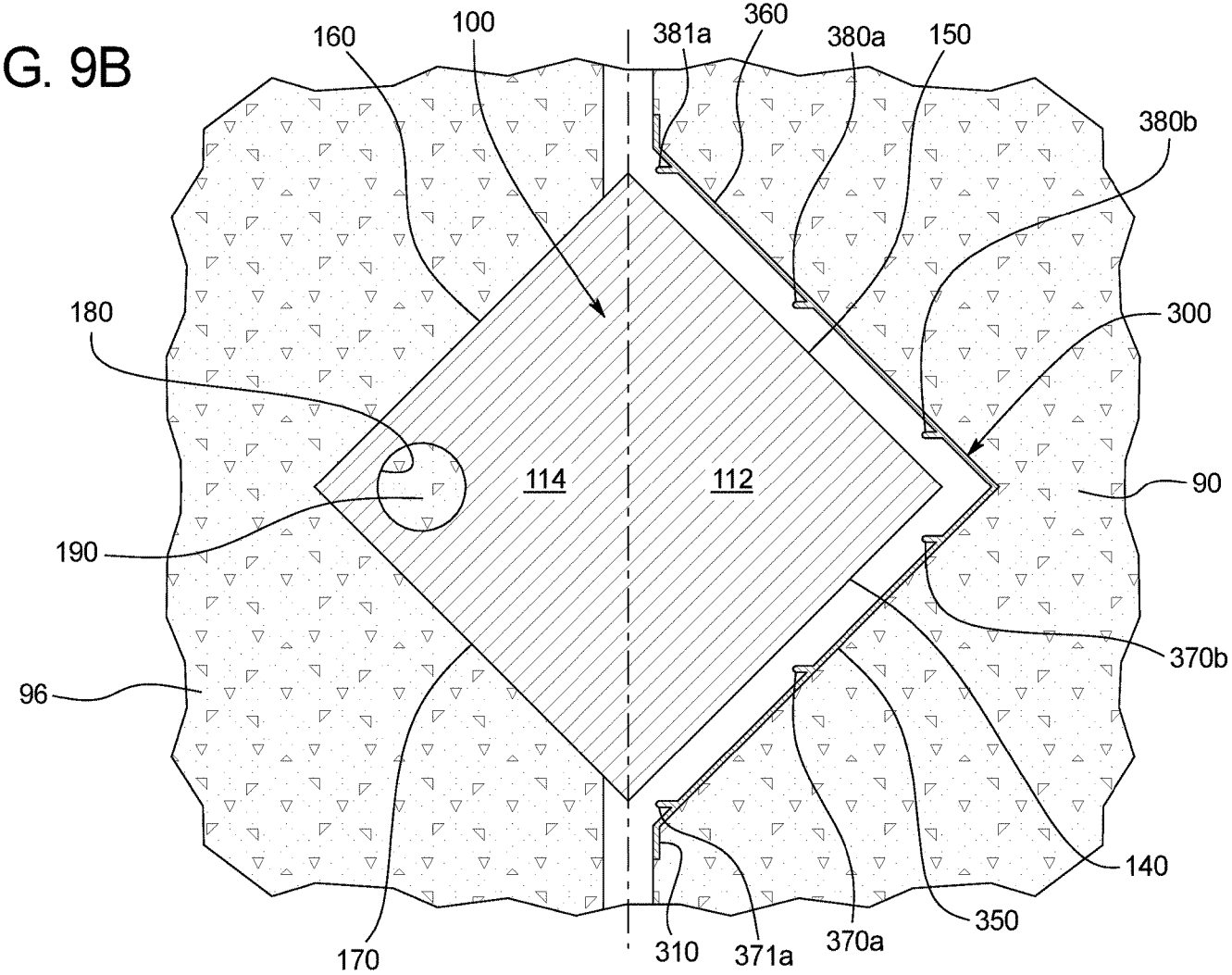

FIGS. 9A and 9B show a subsequent point in time when the two adjacent cast-in-place concrete slabs 90 and 96 have cured and separated. FIGS. 9A and 9B show that the load transfer plate 100 has remained in the same position relative to the concrete slab 96 because it is secured to the concrete slab 96. FIGS. 9A and 9B also show that load transfer plate 100 has moved with respect to slab 90 such that the central or widest area of the load transfer plate 100 is positioned along or substantially along the central plane 98 between the separated concrete slabs 90 and 96. FIGS. 9A and 9B thus show that this load transfer plate 100 has moved to or close to an optimal position relative to the concrete slabs 90 and 96 for transferring loads vertical or substantially vertical loads between the concrete slabs 90 and 96. The load transfer plate 100 is thus better configured to transfer loads between the first and second concrete slabs as loads are directed perpendicular to or substantially perpendicular to the upper and lower surfaces of the first and second concrete slabs 90 and 96.

As indicated or mentioned above, the present disclosure further provides a method of installing the load transfer plate pocket 300 and the load transfer plate 100 for transferring loads between a first cast-in-place concrete slab and a second cast-in-place concrete slab. In various embodiments, the method includes the steps of: (1) placing an edge form on the ground or other suitable substrate; (2) attaching a load transfer plate pocket 300 to the edge form such that part of the load transfer plate pocket 300 extends into the area where the first concrete slab 90 will be formed; (3) pouring the concrete material which forms the first concrete slab 90; (4) allowing the first concrete slab 90 to cure or harden to a certain degree; (5) removing the edge form from the first concrete slab 90 such that the load transfer plate pocket 300 remains within and attached to the first concrete slab 90; (6) inserting the first portion 112 of the load transfer plate 100 into the substantially load transfer plate pocket 300 such that the second portion 114 of the load transfer plate 100 is also partially in the load transfer plate pocket 300 and protrudes into second area where the second concrete slab 96 will be formed; (7) pouring the concrete material that forms the second cast-place concrete slab 96 into the second area where the second concrete slab 96 will be formed; and (8) allowing the second concrete slab 96 to cure or harden. This method enables the load transfer plate 100 and the load transfer plate pocket 300 to be configured to enable the load transfer plate 100 to move with and as the central plane between the two concrete slabs 90 and 96 moves. This method also enables the load transfer plate 100 to be positioned with its widest area along or as close as possible to the vertically extending central plane between the two concrete slabs 90 and 96.

Figure 10:
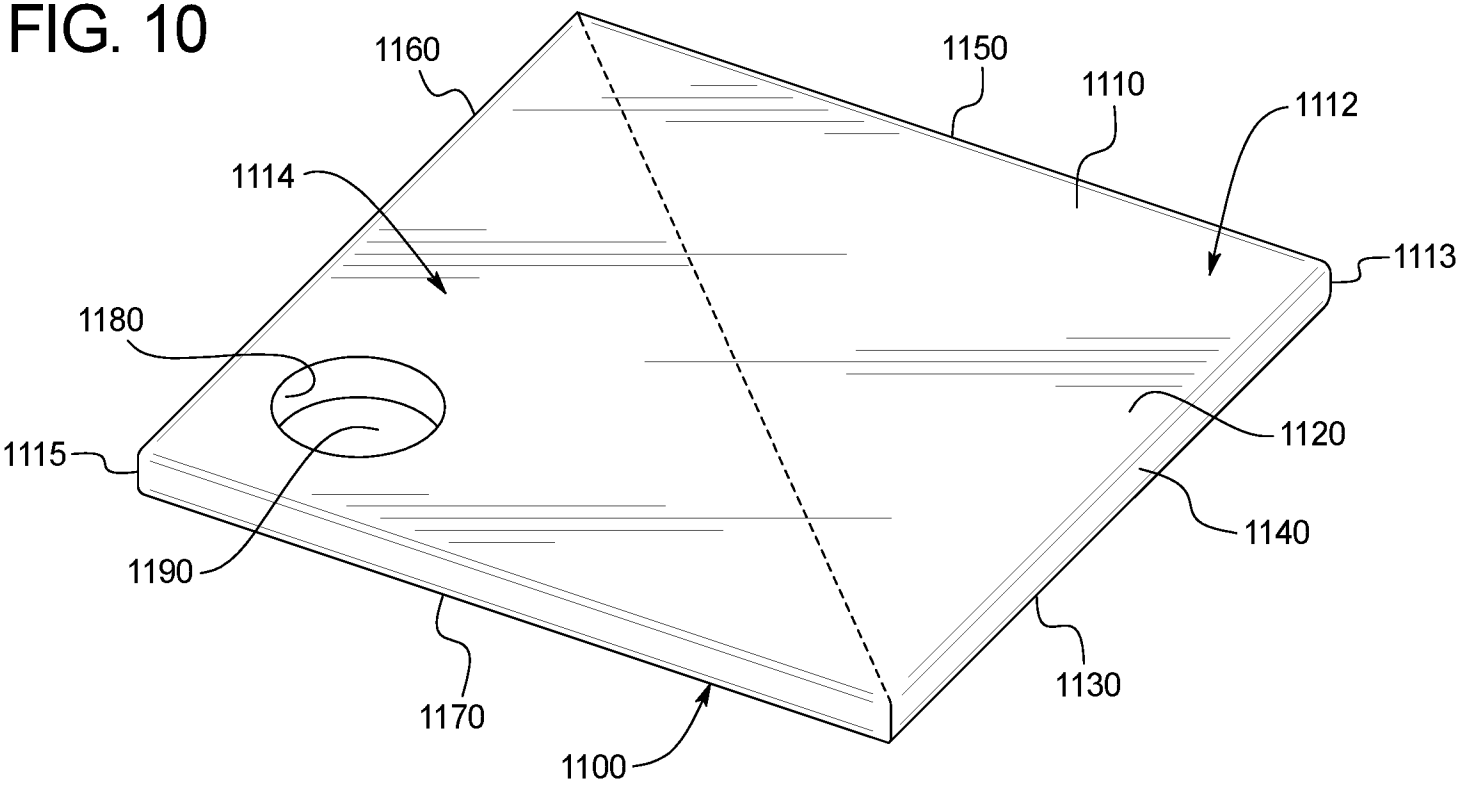
FIG. 10 is a top perspective view of the load transfer plate of an alternative example embodiment of the present disclosure.

Referring now to FIG. 10, another example embodiment of the load transfer plate of the present disclosure is generally indicated by numeral 1100. In this illustrated example embodiment, the load transfer plate 1100 includes a generally diamond shaped body 1110 having: (a) a substantially tapered first half or portion 1112 configured to protrude into and move with respect to the load transfer plate pocket 300 that is secured in the first concrete slab 90; and (b) a substantially tapered second half or portion 1114 configured to protrude into and be secured in the second concrete slab 96. The body 1110 of the load transfer plate 1100 also generally includes: (a) a substantially planar upper surface 1120; (b) a substantially planar lower surface 1130; (c) a first stress reducing outer edge 1140; (d) a second stress reducing outer edge 1150; (e) a third stress reducing outer edge 1160; (f) a fourth stress reducing outer edge 1170; and (g) an interior edge 1180 that defines a slab attachment opening 1190.

In this illustrated example embodiment, the substantially tapered first portion 1112 has a largest width (measured parallel to the longitudinal axis of the joint) at the area of the first portion 1112 adjacent to tapered second portion 1114, and a smallest width at the point 1113. In this illustrated example embodiment, the first portion 1112 is uniformly tapered from the area of the first portion 1112 adjacent to second portion 1114 to the point 1113; however, such taper does not have to be uniform in accordance with the present disclosure.

In this illustrated example embodiment, the substantially tapered second portion 1114 has a largest width (measured parallel to the longitudinal axis of the joint) at the area of the second portion 1114 adjacent to tapered first portion 1112, and a smallest width at the point 1115. In this illustrated example embodiment, the second portion 1114 is uniformly tapered from the area of the second portion 1114 adjacent to first portion 1112 to the point 1115; however, such taper does not have to be uniform in accordance with the present disclosure.

Accordingly, in this illustrated example embodiment, the load transfer plate 1100 has its greatest width at the area where the substantially tapered first portion 1112 and the substantially tapered second portion 1114 meet or connect (i.e. along a center line or plane). In this illustrated example embodiment, the load transfer plate 1100 is also relatively wide compared to its thickness or height and has a length to width ratio of approximately 1:1; however, it should be appreciated that the width compared to the thickness or height may vary, in accordance with the present disclosure.

The first stress reducing outer edge 1140 includes a somewhat semi-cylindrical, rounded, or curved side edge. The second stress reducing outer edge 1150 includes a somewhat semi-cylindrical, rounded, or curved side edge. The third stress reducing outer edge 1160 includes a somewhat semi-cylindrical, rounded, or curved side edge. The fourth stress reducing outer edge 1170 includes a somewhat semi-cylindrical, rounded, or curved side edge.

In this illustrated example embodiment, the semi-cylindrical, rounded, or curved stress reducing outer side edges 1140, 1150, 1160, and 1170 reduce the concentrated stresses that the outer edges of the load transfer plate 1100 place on the portions of the concrete slab when vertical loads are placed on the load transfer plate 1100. More specifically, these semi-cylindrical, rounded, or curved outer side edges 1140, 1150, 1160, and 1170 spread the forces from a single line along the concrete slab to a wider area to reduce the concentrated stresses that the outer edges of the load transfer plate 1100 place on the portions of the concrete slab when vertical loads are placed on the load transfer plate 1100. These semi-cylindrical, rounded, or curved outer side edges 1140, 1150, 1160, and 1170 additionally increase the amount of vertical load that can be placed on the load transfer plate 1100 before the load transfer plate 1100 causes a crack in the concrete slab.

Figure 11:
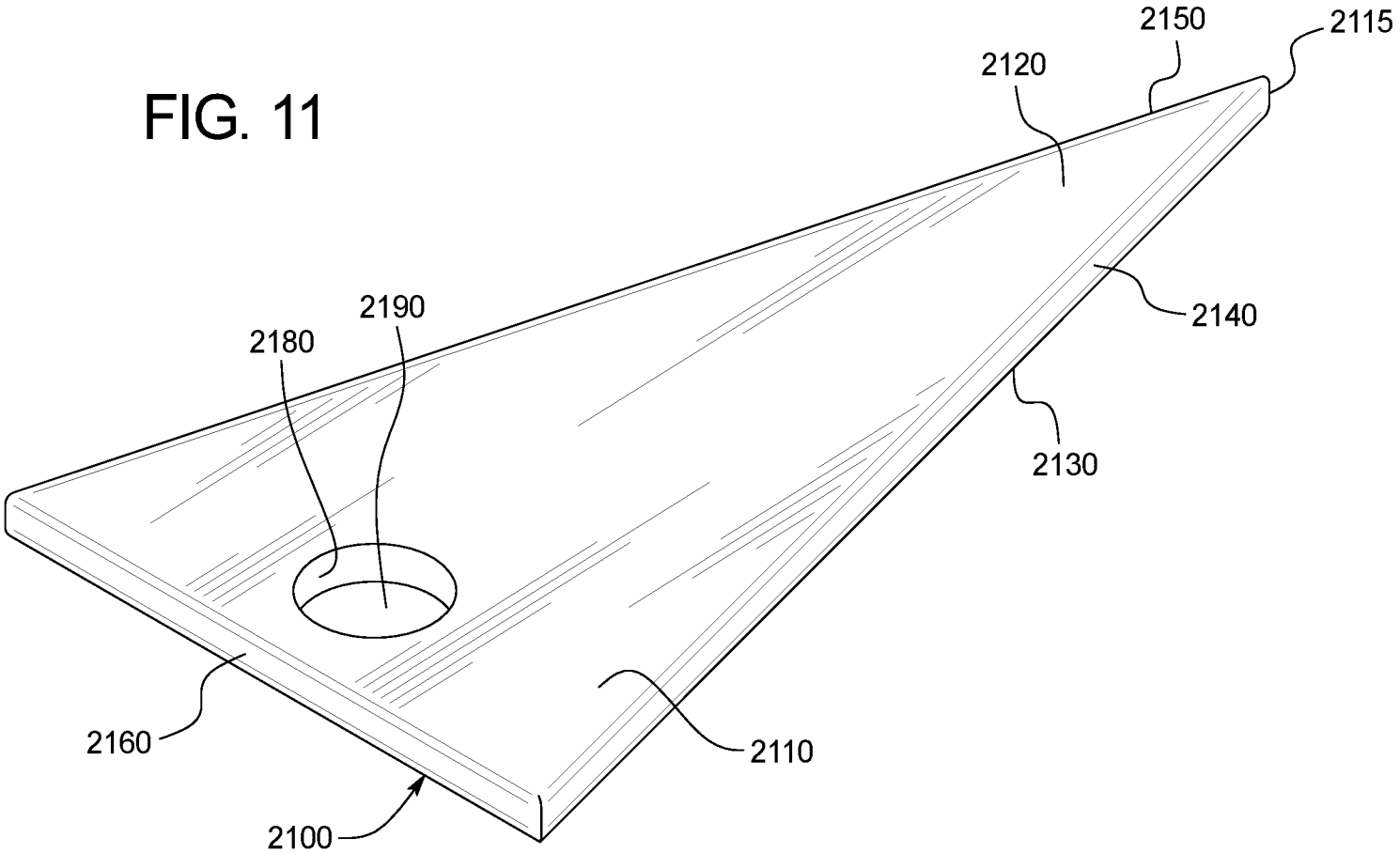
FIG. 11 is a top perspective view of the load transfer plate of another alternative example embodiment of the present disclosure.

Referring now to FIG. 11, another example embodiment of the load transfer plate of the present disclosure is generally indicated by numeral 2100. In this illustrated example embodiment, the load transfer plate 2100 includes a generally triangular tapered body 2110 configured to protrude into and move with respect to the load transfer plate pocket 300 that is secured in the first slab 90. This illustrated embodiment can also be employed in accordance with the load transfer system disclosed in U.S. Pat. No. 7,481,031, which is incorporated herein by reference.

The body 2110 of the load transfer plate 2100 also generally includes: (a) a substantially planar upper surface 2120; (b) a substantially planar lower surface 2130; (c) a first stress reducing outer edge 2140; (d) a second stress reducing outer edge 2150; (e) a third stress reducing outer edge 2160; and (f) an interior edge 2180 that defines a slab attachment opening 2190. In this illustrated example embodiment, the body 2110 is uniformly tapered; however, such taper does not have to be uniform in accordance with the present disclosure. In this illustrated example embodiment, the substantially tapered body 2110 has a largest width at one end and a smallest width at the point 2115. In this illustrated example embodiment, the load transfer plate 2100 is also relatively wide compared to its thickness or height and has a length to width ratio of approximately 1:1; however, it should be appreciated that the width compared to the thickness or height, may vary in accordance with the present disclosure.

The first stress reducing outer edge 2140 includes a somewhat semi-cylindrical, rounded, or curved side edge 2142. The second stress reducing outer edge 2150 includes a somewhat semi-cylindrical, rounded, or curved side edge 2152. The third stress reducing outer edge 2160 includes a somewhat semi-cylindrical, rounded, or curved side edge 2162.

In this illustrated example embodiment, the semi-cylindrical, rounded, or curved stress reducing outer side edges 2140, 2150, and 2160 reduce the concentrated stresses that the outer edges of the load transfer plate 2100 place on the portions of the concrete slab when vertical loads are placed on the load transfer plate 2100. More specifically, these semi-cylindrical, rounded, or curved outer side edges 2140, 2150, and 2160 spread the forces from a single line along the concrete slab to a wider area to reduce the concentrated stresses that the stress reducing outer edges of the load transfer plate 2100 place on the portions of the concrete slab when vertical loads are placed on the load transfer plate 2100. These semi-cylindrical, rounded, or curved outer side edges 2140, 2150, and 2160 additionally increase the amount of vertical load that can be placed on the load transfer plate 2100 before the load transfer plate 2100 causes a crack in the concrete slab.

Figure 12:
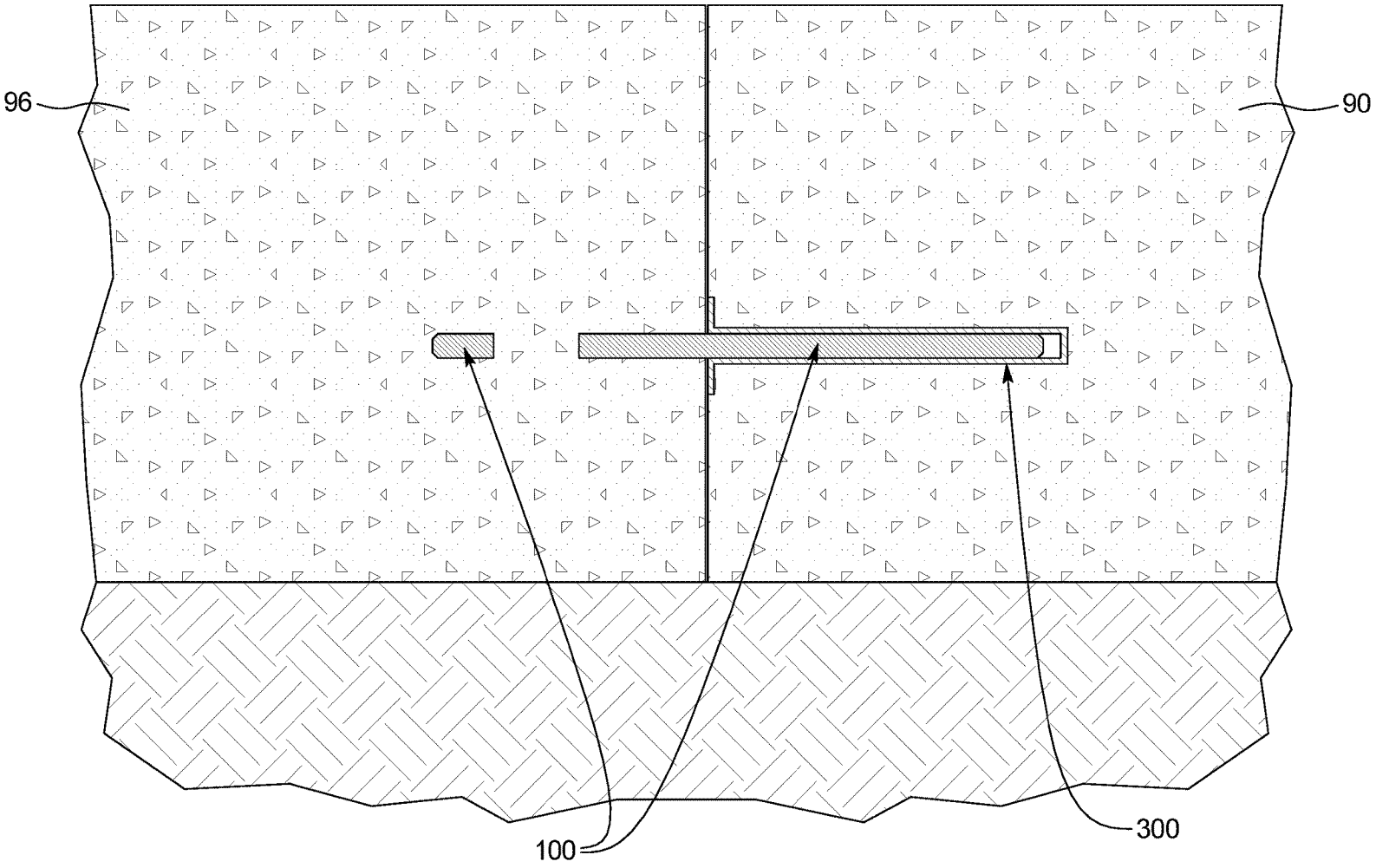
FIG. 12 is an enlarged side cross-sectional views of two adjacent concrete slabs, illustrating the two adjacent concrete slabs before they have shrunk, illustrating the load transfer plate pocket of FIGS. 7A and 7B positioned in the first concrete slab, and illustrating the load transfer plate of FIG. 6A positioned partially in the load transfer plate pocket and partially in the second concrete slab, and shown without the known joint edge assembly of FIGS. 1, 2, and 3.

It should be appreciated that the load transfer plate and load transfer plate pocket can be employed without the joint edge assembly of FIGS. 1, 2, and 3 or other joint edge assembly. For example, as shown in FIG. 12, the load transfer plate pocket 300 is mounted in concrete slab 90 and the load transfer plate 100 extending into the load transfer plate pocket 300 and is attached to the second concrete slab 96. Neither of these concrete slabs include the known joint edge assembly of FIGS. 1, 2, and 3 or any other such joint edge assembly.

Figure 13A:
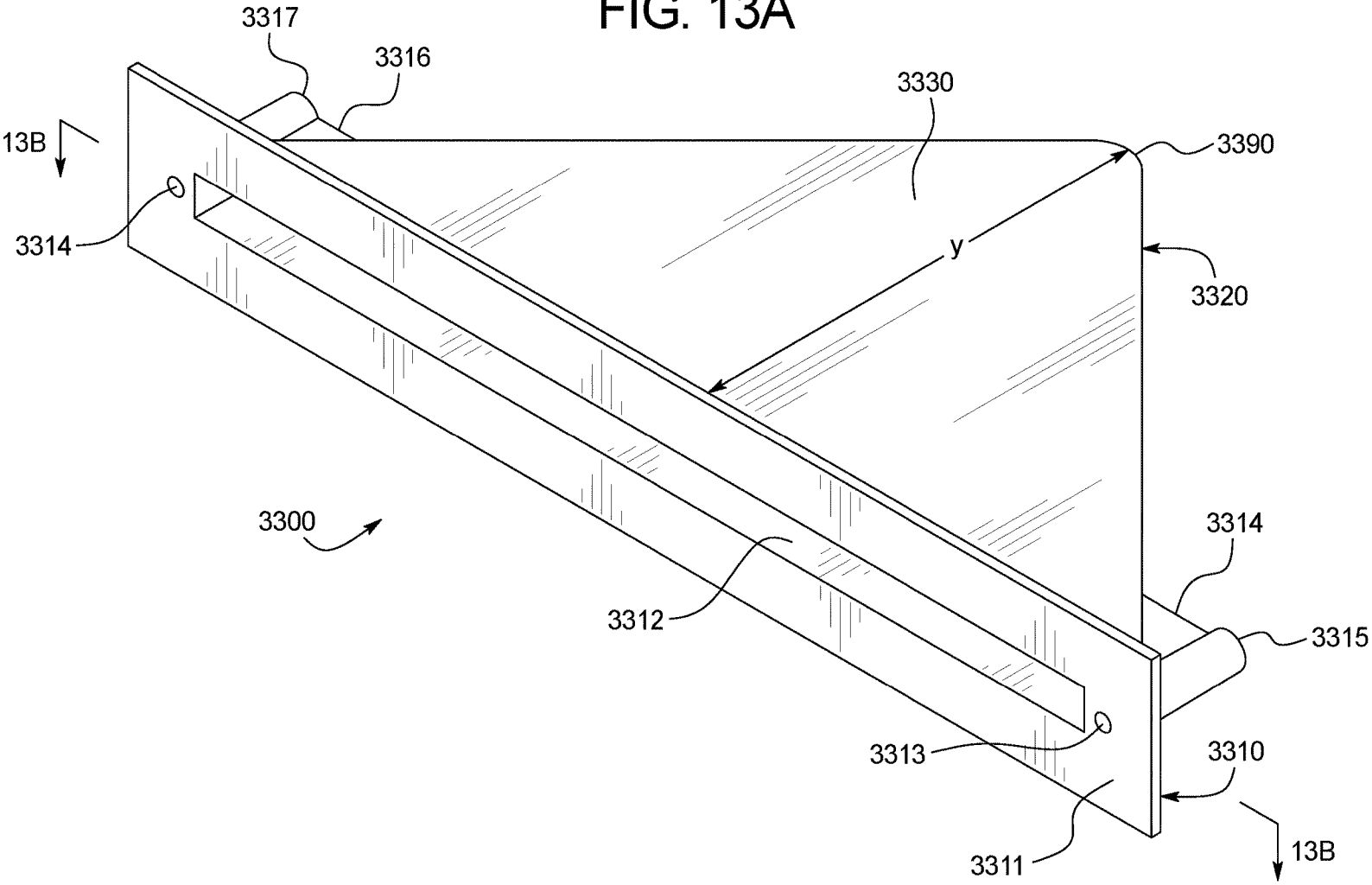
FIG. 13A is a top perspective view of the load transfer plate pocket of another example embodiment of the present disclosure.
Figure 13B:
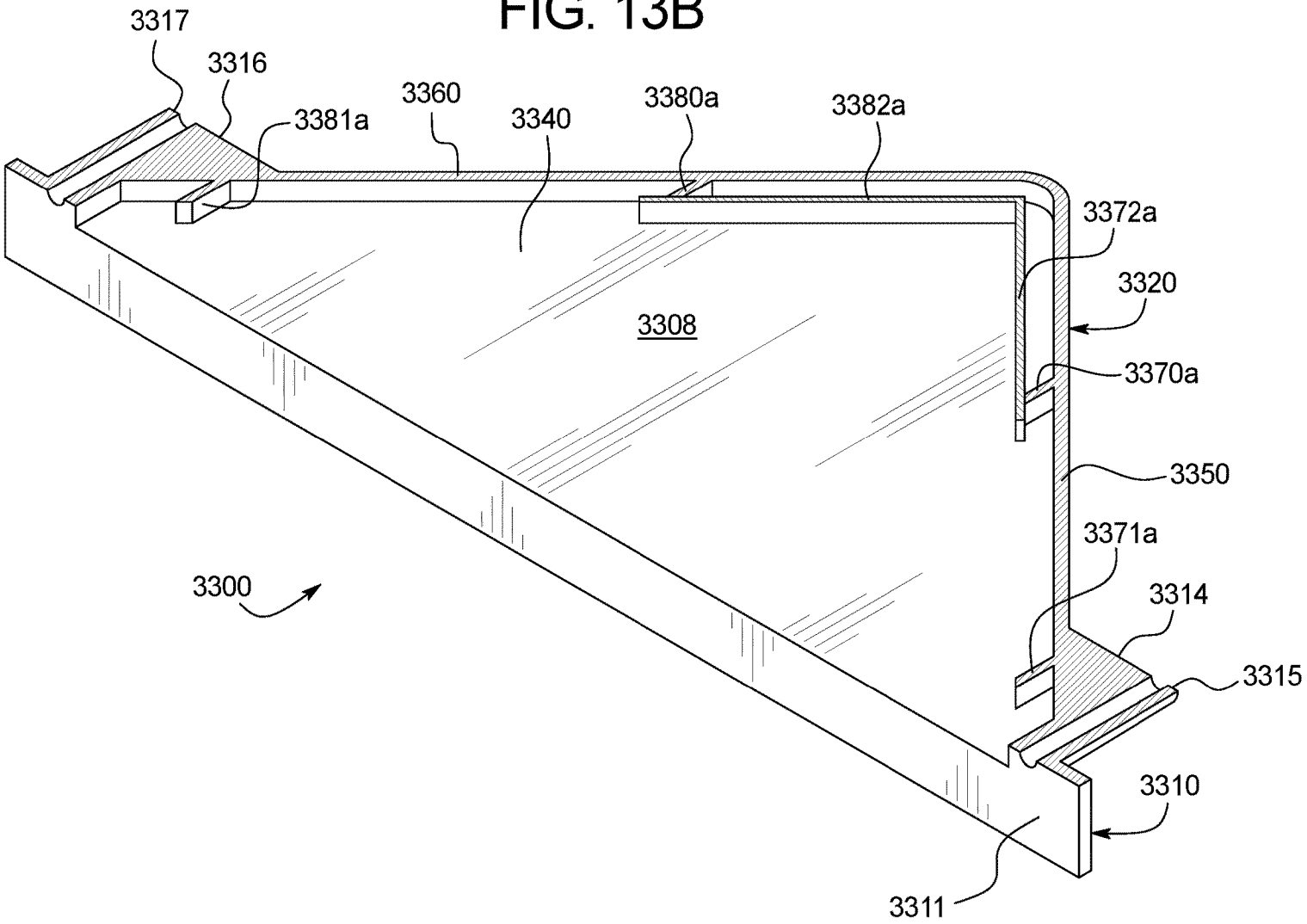
FIG. 13B is a horizontal cross-sectional perspective view of the load transfer plate pocket of FIG. 13A, taken substantially through line 13B-13B showing interior portions of the load transfer plate pocket.
Figure 14:
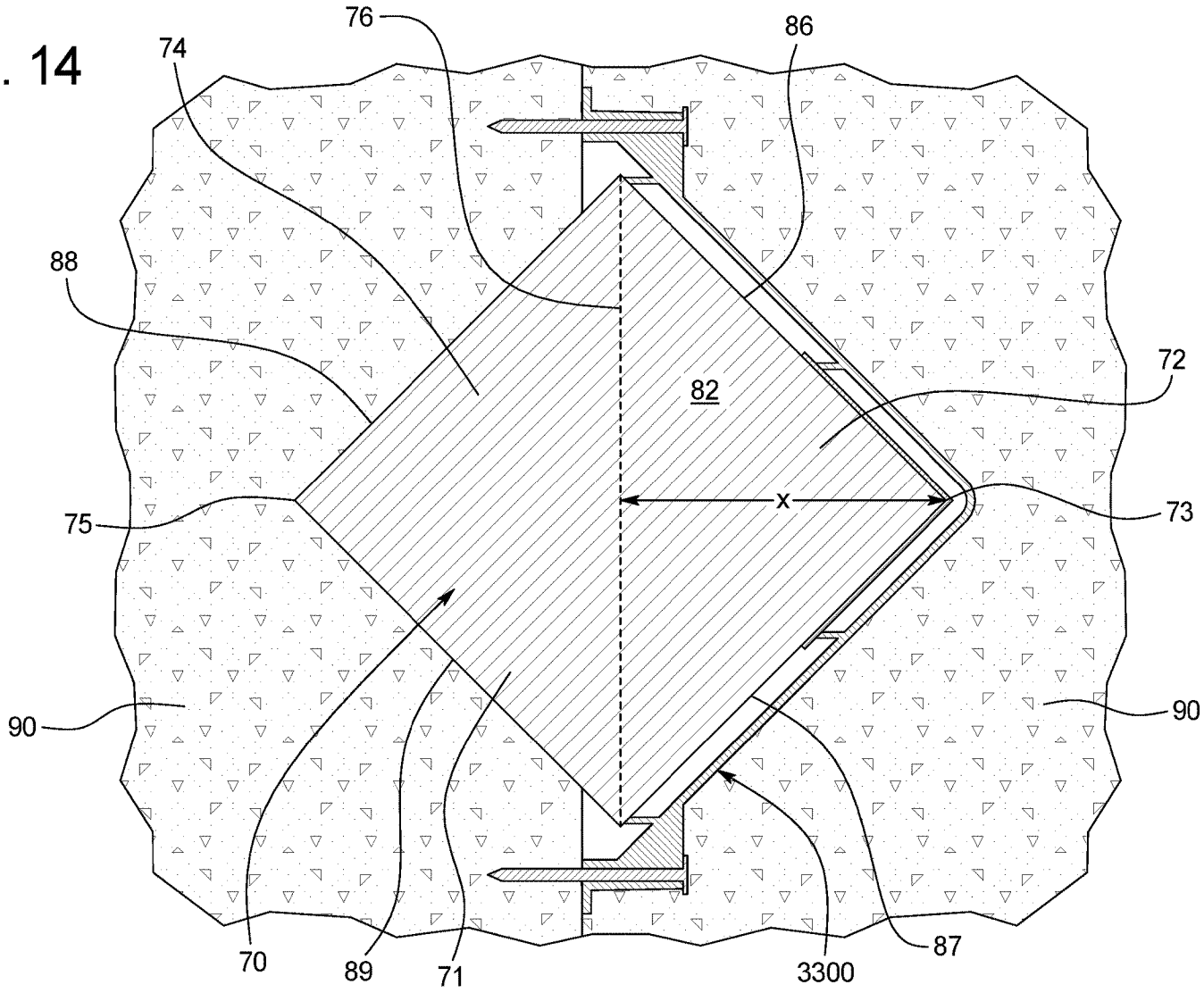
FIG. 14 is an enlarged top cross-sectional view of the load transfer plate pocket of FIGS. 13A and 13B shown mounted to the two adjacent concrete slabs, illustrating the two adjacent concrete slabs before they have shrunk and separated, and illustrating the load transfer plate pocket of FIGS. 13A and 13B positioned in the first concrete slab, and further illustrating a load transfer plate positioned partially in the load transfer plate pocket and partially in the second concrete slab.

Referring now to FIGS. 13A, 13B, and 14, another example embodiment of the load transfer plate pocket of the present disclosure is generally indicated by numeral 3300. The load transfer plate pocket 3300 is configured to receive and co-act or work with any of load transfer plates described above, the known load transfer plate 70 shown in FIGS. 4A, 4B, 5A, and 5B (as shown in FIG. 14), or any other suitable load transfer plate of suitable dimensions.

FIG. 14 also generally partially illustrates one method of employing or installing the load transfer plate pocket 3300 and a load transfer plate such as load transfer plate 70 in accordance with the present disclosure in a first cast-in-place slab (such as a first concrete slab 90) and a second cast-in-place slab (such as a second concrete slab 96). It should be appreciated that multiple spaced apart sets of load transfer plate pockets 3300 and suitable load transfer plates such as load transfer plate 70 will be employed in such adjacent concrete slabs to co-act to transfer vertical or substantially vertical loads from one concrete slab to the adjacent concrete slab in an enhanced manner by optimizing the positions of the load transfer plates relative to the adjacent concrete slabs for load transfer between the adjacent concrete slabs.

In this illustrated example embodiment shown in FIGS. 13A, 13B, and 14, concrete slab 90 is poured before concrete slab 96. In this illustrated example embodiment, the load transfer plate pocket 3300 is configured to be attached to a conventional form (not shown) before the first concrete slab 90 is poured such that the load transfer plate pocket 3300 extends into the first concrete slab 90 and is maintained in the first concrete slab 90 after the first concrete slab 90 is poured and hardened or cured as shown in FIG. 14. The load transfer plate such as load transfer plate 70 is configured to be inserted in the load transfer plate pocket 3300 after (or alternatively before) the first concrete slab 90 is poured, and before the second concrete slab 96 is poured.

It should be appreciated that in an alternative method of the present disclosure, if slab 96 is poured before slab 90, then the load transfer plate pocket 3300 would be attached to a form (not shown) before the concrete slab 96 is poured such that the load transfer plate pocket 3300 extends into the concrete slab 96 and would be maintained in the concrete slab 96 after the concrete slab 96 is poured and hardened or cured. If concrete slab 96 is poured before concrete slab 90, the load transfer plate such as load transfer plate 70 would be inserted in the load transfer plate pocket 3300 after (or alternatively before) the concrete slab 96 is poured, and before the concrete slab 90 is poured.

In this illustrated example embodiment, the load transfer plate 70 includes a generally diamond shaped body 71 having: (a) a substantially tapered first half or portion 72 configured to protrude into and move with respect to the load transfer plate pocket 3300 that is secured in the first concrete slab 90; and (b) a substantially tapered second half or portion 74 configured to be initially partially positioned in the load transfer plate pocket 3300 at installation and also protrude into and be secured in the second concrete slab 96. In this illustrated embodiment, the substantially tapered first portion 72 and the substantially tapered second portion 74 are substantially equal in size and shape and meet at a center line or plane 76.

In this illustrated example embodiment, the substantially tapered first portion 72 has a largest width (measured parallel to the longitudinal axis of the joint) at the area of the first portion 72 adjacent to tapered second portion 74, and a smallest width at the point 73. In this illustrated example embodiment, the first portion 72 is uniformly tapered from the area of the first portion 72 adjacent to second portion 74 to the point 73; however, such taper does not have to be uniform in accordance with the present disclosure.

In this illustrated example embodiment, the substantially tapered second portion 74 has a largest width (measured parallel to the longitudinal axis of the joint) at the area of the second portion 74 adjacent to tapered first portion 72, and a smallest width at the point 75. In this illustrated example embodiment, the second portion 74 is uniformly tapered from the area of the second portion 74 adjacent to first portion 72 to the point 75; however, such taper does not have to be uniform in accordance with the present disclosure.

Accordingly, in this illustrated example embodiment, the load transfer plate 70 has its greatest width at the area where the substantially tapered first portion 72 and the substantially tapered second portion 74 meet or connect (i.e., along the center line or plane 76).

In this illustrated example embodiment, the load transfer plate 70 is also relatively wide compared to its thickness or height and has a length to width ratio of approximately 1:1; however, it should be appreciated that the width compared to the thickness or height may vary, and that the length to width ratio may vary in accordance with the present disclosure.

The body 71 of the load transfer plate 70 also generally includes: (a) a substantially planar upper surface 82; (b) a substantially planar lower surface (not labeled); (c) a first outer edge 86; (d) a second outer edge 87; (e) a third outer edge 88; and (f) a fourth outer edge 89.

This illustrated example embodiment of the load transfer plate pocket 3300 includes an attachment wall 3310 and a generally triangular shaped body 3320 integrally formed and extending from the back or back face of the attachment wall 3310. The body 3320 of this illustrated example load transfer plate pocket 3300 includes: (a) a triangular upper wall 3330; (b) a triangular lower wall 3340; (c) a first side wall 3350; (d) a second side wall 3360; (f) a first load transfer plate positioner 3370*a*; (g) a second load transfer plate positioner 3380*a*; (h) a first load transfer plate engager 3372*a*; (i) a second load transfer plate engager 3382*a*; (j) a third load transfer plate centering positioner 3371*a*; and (k) a fourth load transfer plate centering positioner 3381*a*.

More specifically, the attachment wall 3310 in this illustrated example embodiment includes a generally flat rectangular body 3311 that defines: (a) a load transfer plate receiving opening or slot 1312; (b) a first fastener opening 3313; and (c) a second fastener opening 3314. The load transfer plate receiving opening or slot 3312 is configured such that the load transfer plate 70 can freely move through the load transfer plate receiving opening or slot 3312. The first fastener opening 3313 and the second fastener opening 3314 are configured to respectively receive fasteners such as nails (not labeled but shown in FIG. 14) that during installation secure and hold the load transfer plate pocket 300 to the form (not shown) before and during pouring of the first concrete slab 90 such that: (a) the attachment wall 3310 extends in the same plane as the outer vertical surface of the first concrete slab 90; and (b) the rest of or the body 3320 of the load transfer plate pocket 3300 extends into the first concrete slab 90.

In this illustrated example embodiment, the body 3320 of the load transfer plate pocket 3300 further includes spaced apart nail guides 3315 and 3317 integrally connected to the back of the attachment wall 3310 for assisting in guiding the nails that secure the load transfer plate pocket 3300 to a removable form (as described herein).

In this illustrated example embodiment, the body 3320 of the load transfer plate pocket 3300 further includes braces or supports 3314 and 3315 respectively integrally connected to the nail guides 3315 and 3317 and the first side wall 3350 and the second side wall 3360 for providing additional structural bracing or support for the load transfer plate pocket 3300.

The triangular upper wall 3330 is integrally connected to the attachment wall 3310. The triangular lower wall 3340 is integrally connected to the attachment wall 3310. The triangular lower wall 3340 is spaced apart from the triangular upper wall 3330 such that the load transfer plate 70 can freely move between the lower wall 3340 and the upper wall 3330.

The first side wall 3350 is integrally connected to the attachment wall 3310 adjacent to one side of the load transfer plate receiving opening or slot 3312. The first side wall 3350 is also integrally connected to the triangular upper wall 3330. The first side wall 3350 is also integrally connected to the triangular lower wall 3330.

The second side wall 3360 is integrally connected to the attachment wall 3310 adjacent to the other side of the load transfer plate receiving opening or slot 3312. The second side wall 3360 is integrally connected to the triangular upper wall 3330. The second side wall 3360 is integrally connected to the triangular lower wall 3330. The second side wall 3360 is integrally formed with and extends the first side wall 3350.

The attachment wall 3310, the triangular upper wall 3330, the triangular lower wall 3340, the first side wall 3350, and the second side wall 3360 define a load transfer plate receiving chamber or area 3308 that in this illustrated example embodiment is configured to receive the entire first half or portion 72 of the load transfer plate 70 and part of the second half or portion 74 of the load transfer plate as generally shown in FIG. 14.

In this illustrated example embodiment, the width of the load transfer plate receiving chamber or area 3308 of the load transfer plate pocket 3300 is greater than the width of the substantially tapered end of the load transfer plate 70 at each corresponding depth along the substantially first tapered half or portion 72 of the load transfer plate 70, such that the substantially first tapered half or portion 72 of the load transfer plate 70 and part of (such as about 10 to 15 percent of) the second half or portion 74 of the load transfer plate 70 can be positioned within the load transfer plate pocket 3300 in a direction parallel to the upper surface of the first slab 96. In other words, in this illustrated embodiment, the load transfer plate 70 and the load transfer plate pocket 3300 are configured and sized such that: (a) the distance X (as shown in FIG. 14) from the point 73 to the center line or plane 76 of the load transfer plate 70 is less than (b) the distance Y (as shown in FIG. 13A) from the end point 3390 to the attachment wall 3310 of the load transfer plate pocket 3300. This size and configuration enables the load transfer plate 70 to be positioned in the load transfer plate pocket 3300 beyond the center line or plane 76 of the load transfer plate 70 such as shown in FIG. 14. This larger load transfer plate pocket 3300 also allows for heat caused expansion of the load transfer plate 70.

The first load transfer plate positioner 3370*a* is integrally connected to and extends inwardly from the first side wall 3350 toward the back face of the attachment wall 3310. The first load transfer plate positioner 3370*a* in this illustrated embodiment is flexible and thus bends when the load transfer plate 70 moves further into or expands further into the pocket or area 3308 and places the first load transfer plate positioner 3370*a* under sufficient pressure.

Likewise, the second load transfer plate positioner 3380*a* is integrally connected to and extends inwardly from the second side wall 3360 toward the back face of the attachment wall 3310. The second load transfer plate positioner 3380*a* is flexible and thus bends when the load transfer plate 70 further moves into the pocket or area 3308 and places the first load transfer plate positioner 3380*a* under sufficient pressure.

In this illustrated embodiment, the first load transfer plate engager 3372*a* and the second load transfer plate engager 3382*a* extend transversely to each other and are integrally connected to each other at their respective first ends and form a plate apex or corner receiving area. In this illustrated example embodiment, the first load transfer plate engager 3372*a* and the second load transfer plate engager 3382*a* extend perpendicular or substantially perpendicular to each other. In this illustrated example embodiment, the first load transfer plate engager 3372*a* and the second load transfer plate engager 3382*a* are respectively integrally connected to the first load transfer plate positioner 3370*a* and the second load transfer plate positioner 3380*a*. In this illustrated example embodiment, the first load transfer plate engager 3372*a* extends parallel to or substantially parallel to the first side wall 3350. In this illustrated example embodiment, the second load transfer plate engager 3382*a* extends parallel to or substantially parallel to the second side wall 3360. In this illustrated example embodiment, the first load transfer plate engager 3372*a* is configured to be engaged by the second outer edge 87 of the load transfer plate 70 as shown in FIG. 14. In this illustrated example embodiment, the second load transfer plate engager 3382*a* is configured to be engaged by the first outer edge 86 of the load transfer plate 70 as shown in FIG. 14.

Thus, (a) the first load transfer plate positioner 3370*a*; (b) b second load transfer plate positioner 3380*a*; (c) the first load transfer plate engager 3372*a*; and (d) the second load transfer plate engager 3382*a*, better receive and engage the load transfer plate 70 and co-act to receive and position the load transfer plate 70. This configuration also accounts for the situation where the concrete slabs are made from a concrete that first expands before it contracts. In such case, this configuration in this illustrated example embodiment allows for such expansion and movement of the load transfer plate 70 further into the load transfer plate pocket 3300 (i.e., into the interior void between the plate 70 and pocket 3300). This configuration also allows for heat expansion of the load transfer plate 70 itself. In certain embodiments, one or more of the load transfer plate positioners 3370*a* and 3380*a* can be configured to break off from the walls or walls of the load transfer plate pocket 3300. It should be appreciated that the quantity and positions of the load transfer plate engager can vary in accordance with the present disclosure.

The load transfer plate pocket 3300 also includes load transfer plate centering positioners 3371*a* and 3381*a* for initially centering the load transfer plate 70 within the width of the load transfer plate pocket 3300 during initial installation of the load transfer plate 70 in the load transfer plate pocket 3300. The load transfer plate centering positioners 3371*a* and 3381*a* are spaced apart such that they engage the opposing side points of the load transfer plate 70 (as shown in FIG. 14). In certain embodiments, the load transfer plate centering positioners 3371*a* and 3381*a* are configured to engage the load transfer plate adjacent to respective first and second tips of the load transfer plate, wherein the first and second tips define a widest area of the load transfer plate, as illustrated in FIGS. 13B and 14. In various embodiments, these load transfer plate centering positioners 3371*a* and 3381*a* are configured to break off from the wall or walls of the load transfer plate pocket 3300 after initial installation.

The present disclosure recognizes that the load transfer plate 70 will generally produce its smallest load per square inch at its widest point. The present disclosure further recognizes that the optimal position for the load transfer plate 70 is thus generally along the vertically extending central plane between the two adjacent concrete slabs 90 and 96. The load transfer plate 70 and the load transfer plate pocket 3300 of the present disclosure are thus configured to cause the load transfer plate 70 to be positioned with its widest area along or as close as possible to the vertically extending central plane between the two concrete slabs 90 and 96. The load transfer plate 70 and the load transfer plate pocket 3300 of the present disclosure are also configured to enable the load transfer plate 70 to move with and as the central plane between the two concrete slabs 90 and 96 moves. In this example embodiment, the concrete of the second concrete slab will engage and cause the load the load transfer plate 70 to move out of the pocket to a more centered position.

FIG. 14 generally illustrates that the load transfer plate 70 and load transfer plate pocket 3300 will optimize the position of the load transfer plate 70 between the adjacent concrete slabs 90 and 96 during installation and when the adjacent concrete slabs 90 and 96 shrink and have moved away from each other an expected distance during the curing process or otherwise (subsequently to curing).

More specifically, FIG. 14 shows two adjacent cast-in-place concrete slabs 90 and 96 before such concrete slabs 90 and 96 have substantially cured and separated, and with the load transfer plate 70 positioned in the load transfer plate pocket 3300 for installation such that the entire first half or portion 72 of the load transfer plate 70 and part of the second half or portion 74 of the load transfer plate is in the load transfer plate pocket 3300. At this point in time, the load transfer plate 70 is not positioned at the optimal position for transferring loads between the two adjacent cast-in-place concrete slabs 90 and 96.

At a subsequent point in time when the two adjacent cast-in-place concrete slabs 90 and 96 have cured and separated (like in FIGS. 9A and 9B), the load transfer plate 70 has remained in the same position relative to the concrete slab 96. The load transfer plate 70 has moved with respect to slab 90 such that the central or widest area of the load transfer plate 70 is positioned along or substantially along a central plane between the separated concrete slabs 90 and 96. Thus, the load transfer plate 70 has moved to or close to an optimal position relative to the concrete slabs 90 and 96 for transferring loads vertical or substantially vertical loads between the concrete slabs 90 and 96. The load transfer plate 100 is thus better configured to transfer loads between the first and second concrete slabs as loads are directed perpendicular to or substantially perpendicular to the upper and lower surfaces of the first and second concrete slabs 90 and 96.

As indicated or mentioned above, the present disclosure further provides a method of installing the load transfer plate pocket 3300 and the load transfer plate 70 for transferring loads between a first cast-in-place concrete slab and a second cast-in-place concrete slab. In various embodiments, the method includes the steps of: (1) placing an edge form on the ground or other suitable substrate; (2) attaching a load transfer plate pocket 3300 to the edge form such that part of the load transfer plate pocket 3300 extends into a first area where the first concrete slab 90 will be formed; (3) pouring the concrete material which forms the first concrete slab 90; (4) allowing the first concrete slab 90 to cure or harden to a certain degree; (5) removing the edge form from the first concrete slab 90 such that the load transfer plate pocket 3300 remains within and attached to the first concrete slab 90; (6) inserting the first portion 72 of the load transfer plate 70 into the substantially load transfer plate pocket 3300 such that the second portion 74 of the load transfer plate 70 is also partially in the load transfer plate pocket 3300 and protrudes into a second area to be occupied by the second concrete slab 96; (7) pouring the concrete material that forms the second cast-place concrete slab 96 into the second area to be occupied by the second concrete slab 96; and (8) allowing the second concrete slab 96 to cure or harden. This method enables the load transfer plate 70 and the load transfer plate pocket 3300 to be configured to enable the load transfer plate 70 to move with and as the central plane between the two concrete slabs 90 and 96 moves. This method also enables the load transfer plate 70 to be positioned with its widest area along or as close as possible to the vertically extending central plane between the two concrete slabs 90 and 96.

In various embodiments of the present disclosure, the load transfer plate and the load transfer plate pocket are made of various suitable materials and in various suitable manners. In certain embodiments, the load transfer plate is made of steel and suitably cut from steel sheets. In other embodiments, the load transfer plate can be otherwise formed such as by 3-D printing. In certain embodiments, the load transfer plate pocket is made of a suitable molded plastic. In other embodiments, the load transfer plate pocket can be otherwise formed such as by 3-D printing.

It should be appreciated from the above that in various embodiments, the present disclosure provides a load transfer plate for transferring loads across a joint between a first cast-in-place concrete slab and a second cast-in-place concrete slab, the load transfer plate comprising: a generally diamond shaped body having: (a) a substantially planar upper surface; (b) a substantially planar lower surface; (c) a first stress reducing outer edge; (d) a second stress reducing outer edge; and (e) an interior edge that defines a slab attachment opening; said generally diamond shaped body having: (i) a substantially tapered first portion configured to protrude into a load transfer plate pocket secured in the first cast-in-place concrete slab; and (ii) a substantially tapered second portion configured to protrude into and be secured in the second cast-in-place concrete slab.

In various such embodiments of the load transfer plate, the first stress reducing outer edge includes: (a) a side edge that extends perpendicular to the upper surface and to the lower surface; (b) a top angled edge that extends downwardly at an obtuse angle from the upper surface to the side edge, and that extends upwardly at an obtuse angle from the side edge to the upper surface; and (c) a bottom angled edge that extends upwardly at an obtuse angle from the lower surface to the side edge, and that extends downwardly at an obtuse angle from the side edge to the lower surface.

In various such embodiments of the load transfer plate, the second stress reducing outer edge includes: (a) a side edge that extends perpendicular to the upper surface and to the lower surface; (b) a top angled edge that extends downwardly at an obtuse angle from the upper surface to the side edge, and that extends upwardly at an obtuse angle from the side edge to the upper surface; and (c) a bottom angled edge that extends upwardly at an obtuse angle from the lower surface to the side edge, and that extends downwardly at an obtuse angle from the side edge to the lower surface.

In various such embodiments of the load transfer plate, the generally diamond shaped body has: (e) a third stress reducing outer edge; and (f) a fourth stress reducing outer edge.

In various such embodiments of the load transfer plate, the first stress reducing outer edge has a semi-cylindrical shape.

In various such embodiments of the load transfer plate, the body defines a plurality of interior edges that respectively define separate slab attachment openings.

In various such embodiments of the load transfer plate, (i) the substantially tapered first portion; and (ii) the substantially tapered second portion are substantially equal is size and shape.

It should also be appreciated from the above that in various embodiments, the present disclosure provides a load transfer plate pocket configured to receive a load transfer plate for transferring loads across a joint between a first cast-in-place concrete slab and a second cast-in-place concrete slab, the load transfer plate pocket comprising: an attachment wall defining a load transfer plate receiving slot; and a generally triangular shaped body extending from a back of the attachment wall, the body including: (a) a generally triangular upper wall; (b) a generally triangular lower wall, said lower wall spaced apart from the upper wall such that the load transfer plate can freely move between the lower wall and the upper wall; (c) a first side wall extending from the back of the attachment wall and connected to the upper wall and to the lower wall; (d) a second side wall extending from the back of the attachment wall and connected to the upper wall and to the lower wall; (f) a first load transfer plate positioner extending from the first side wall; (g) a second load transfer plate positioner extending from the second side wall; (h) a centering third load transfer plate positioner extending from the first side wall; and (i) a centering fourth load transfer plate positioner extending from the second side wall.

It should also be appreciated from the above that in various embodiments, the present disclosure provides a load transfer apparatus for transferring loads across a joint between a first cast-in-place concrete slab and a second cast-in-place concrete slab, the load transfer apparatus comprising: (A) a load transfer plate including a generally diamond shaped body having: (a) a substantially planar upper surface; (b) a substantially planar lower surface; (c) a first stress reducing outer edge; (d) a second stress reducing outer edge; and (e) an interior edge that defines a slab attachment opening; said generally diamond shaped body having: (i) a substantially tapered first portion; and (ii) a substantially tapered second portion configured to protrude into and be secured in the second cast-in-place concrete slab; and (B) a load transfer plate pocket configured to receive the load transfer plate, the load transfer plate pocket including: an attachment wall defining a load transfer plate receiving slot; and a generally triangular shaped body extending from a back of the attachment wall, the body including: (a) a generally triangular upper wall; (b) a generally triangular lower wall, said lower wall spaced apart from the upper wall such that the load transfer plate can freely move between the lower wall and the upper wall; (c) a first side wall extending from the back of the attachment wall and connected to the upper wall and to the lower wall; (d) a second side wall extending from the back of the attachment wall and connected to the upper wall and to the lower wall; (f) a first load transfer plate positioner extending from the first side wall; (g) a second load transfer plate positioner extending from the second side wall; (h) a centering third load transfer plate positioner extending from the first side wall; and (i) a centering fourth load transfer plate positioner extending from the second side wall.

In various such embodiments of the load transfer apparatus, the load transfer plate and the load transfer plate pocket are configured and sized such that: the load transfer plate can be positioned in the load transfer plate pocket beyond a center line of the load transfer plate.

It should also be appreciated from the above that in various embodiments, the present disclosure provides a load transfer apparatus for transferring loads across a joint between a first cast-in-place concrete slab and a second cast-in-place concrete slab, the load transfer apparatus comprising: (A) a load transfer plate including a generally diamond shaped body having: (a) a substantially planar upper surface; (b) a substantially planar lower surface; and (c) an interior edge that defines a slab attachment opening; said generally diamond shaped body having: (i) a substantially tapered first portion; and (ii) a substantially tapered second portion configured to protrude into and be secured in the second cast-in-place concrete slab; and (B) a load transfer plate pocket configured to receive the load transfer plate, the load transfer plate pocket including: an attachment wall defining a load transfer plate receiving slot; and a body extending from a back of the attachment wall, the body including: (a) an upper wall; (b) a lower wall, said lower wall spaced apart from the upper wall such that the load transfer plate can freely move between the lower wall and the upper wall; (c) a first side wall extending from the back of the attachment wall and connected to the upper wall and to the lower wall; (d) a second side wall extending from the back of the attachment wall and connected to the upper wall and to the lower wall; (e) a first centering load transfer plate positioner extending from the first side wall; and (f) a second centering load transfer plate positioner extending from the second side wall, wherein the load transfer plate and the load transfer plate pocket are configured and sized such that the load transfer plate can be positioned in the load transfer plate pocket beyond a center line of the load transfer plate.

It should also be appreciated from the above that in various embodiments, the present disclosure provides a method of for transferring loads across a joint between a first concrete slab and a second concrete slab, said method comprising: (a) placing an edge form on a ground surface; (b) attaching a load transfer plate pocket to the edge form such that part of the load transfer plate pocket extends into a first area where the first concrete slab will be formed, said load transfer pocket configured to receive a load transfer plate, said load transfer plate including a generally diamond shaped body having: (i) a substantially planar upper surface; (ii) a substantially planar lower surface; (iii) a first outer edge; (iv) a second outer edge; (v) a third outer edge; (vi) a fourth outer edge; and (vii) an interior edge that defines a slab attachment opening; (c) pouring concrete material which forms the first concrete slab; (d) allowing the first concrete slab to partially cure; (e) removing the edge form from the first concrete slab such that the load transfer plate pocket remains at least partially within and attached to the first concrete slab; (f) inserting the load transfer plate into the load transfer plate pocket such that a portion of the second half of the load transfer plate protrudes into a second area where the second concrete slab will be formed; (g) pouring concrete material that forms the second concrete slab into the second area where the second concrete slab will be formed such that part of such concrete extends through the slab attachment opening of the load transfer plate; and (h) allowing the second concrete slab to partially cure such that the load transfer plate is secured to the second concrete slab.

It should also be appreciated from the above that in various embodiments, the present disclosure provides a method of for transferring loads across a joint between concrete first concrete slab and a second concrete slab, said method comprising: (a) placing an edge form on a ground surface; (b) attaching a load transfer plate pocket to the edge form such that part of the load transfer plate pocket extends into a first area where the first concrete slab will be formed; (c) pouring concrete material which forms the first concrete slab; (d) allowing the first concrete slab to partially cure; (e) removing the edge form from the first concrete slab such that the load transfer plate pocket remains at least partially within and attached to the first concrete slab; (f) inserting a first half of the load transfer plate into the load transfer plate pocket and a portion of a second half of the load transfer plate into the load transfer plate pocket, such that a portion of the second half of the load transfer plate protrudes into a second area to be occupied by the second concrete slab; (g) pouring concrete material that forms the second concrete slab into the second area to be occupied by the second concrete slab; and (h) allowing the second concrete slab to cure.

It should further be appreciated from the above that in various embodiments, the present disclosure provides a load transfer plate pocket configured to receive a load transfer plate for transferring loads across a joint between a first cast-in-place concrete slab and a second cast-in-place concrete slab, the load transfer plate pocket comprising: an attachment wall defining a load transfer plate receiving slot; and a generally triangular shaped body extending from the attachment wall, the body including: (a) a generally triangular upper wall; (b) a generally triangular lower wall, said lower wall spaced apart from the upper wall such that the load transfer plate can freely move between the lower wall and the upper wall; (c) a first side wall connected to the upper wall and to the lower wall; (d) a second side wall connected to the upper wall and to the lower wall; (e) a first load transfer plate positioner extending from the first side wall; (f) a second load transfer plate positioner extending from the second side wall; (g) a centering third load transfer plate positioner extending from the first side wall; and (h) a centering fourth load transfer plate positioner extending from the second side wall.

In various such embodiments of the load transfer plate pocket, the pocket is configured and sized such that the load transfer plate can be positioned in the load transfer plate pocket beyond a center line of the load transfer plate.

In various such embodiments of the load transfer plate pocket, the pocket includes: (i) a third load transfer plate positioner extending from the first side wall; and (j) a fourth load transfer plate positioner extending from the second side wall.

In various such embodiments of the load transfer plate pocket, the pocket includes: (i) a first load transfer plate engager connected to the first load transfer plate positioner;

and (j) a second load transfer plate engager connected to the second load transfer plate positioner.

In various such embodiments of the load transfer plate pocket, the first load transfer plate engager is connected to the second load transfer plate engager.

In various such embodiments of the load transfer plate pocket, the first load transfer plate engager is connected to the second load transfer plate engager at a substantially perpendicular angle.

In various such embodiments of the load transfer plate pocket, the first load transfer plate engager extends substantially parallel to the first side wall.

In various such embodiments of the load transfer plate pocket, the second load transfer plate engager extends substantially parallel to the second side wall.

In various such embodiments of the load transfer plate pocket, the first load transfer plate engager is configured to engage a first side edge of a load transfer plate.

In various such embodiments of the load transfer plate pocket, the second load transfer plate engager is configured to engage a second side edge of the load transfer plate.

It should further be appreciated from the above that in various embodiments, the present disclosure provides a load transfer plate pocket configured to receive a load transfer plate for transferring loads across a joint between a first cast-in-place concrete slab and a second cast-in-place concrete slab, the load transfer plate pocket comprising: an attachment wall defining a load transfer plate receiving slot; and a generally triangular shaped body extending from the attachment wall, the body including: (a) a generally triangular upper wall; (b) a generally triangular lower wall, said lower wall spaced apart from the upper wall such that the load transfer plate can freely move between the lower wall and the upper wall; (c) a first side wall connected to the upper wall and to the lower wall; and (d) a second side wall connected to the upper wall and to the lower wall; wherein the load transfer plate pocket is configured and sized such that the load transfer plate can be positioned in the load transfer plate pocket beyond a center line of the load transfer plate.

In various such embodiments of the load transfer plate pocket, the pocket includes: (e) a first load transfer plate positioner extending from the first side wall; and (f) a second load transfer plate positioner extending from the second side wall.

In various such embodiments of the load transfer plate pocket, the pocket includes: (g) a centering third load transfer plate positioner extending from the first side wall; and (h) a centering fourth load transfer plate positioner extending from the second side wall.

In various such embodiments of the load transfer plate pocket, the pocket includes: (e) a centering third load transfer plate positioner extending from the first side wall; and (f) a centering fourth load transfer plate positioner extending from the second side wall.

It should further be appreciated from the above that in various embodiments, the present disclosure provides a load transfer apparatus for transferring loads across a joint between a first cast-in-place concrete slab and a second cast-in-place concrete slab, the load transfer apparatus comprising: (A) a load transfer plate including a generally diamond shaped body having: (a) a substantially planar upper surface; and (b) a substantially planar lower surface; said generally diamond shaped body having: (i) a substantially tapered first portion; and (ii) a substantially tapered second portion configured to protrude into and be secured in the second cast-in-place concrete slab; and (B) a load transfer plate pocket configured to receive the load transfer plate, the load transfer plate pocket including: an attachment wall defining a load transfer plate receiving slot; and a body extending from the attachment wall, the body including: (a) an upper wall; (b) a lower wall, said lower wall spaced apart from the upper wall such that the load transfer plate can freely move between the lower wall and the upper wall; (c) a first side wall extending from the attachment wall and connected to the upper wall and to the lower wall; (d) a second side wall extending from the attachment wall and connected to the upper wall and to the lower wall; (e) a first centering load transfer plate positioner extending from the first side wall; and (f) a second centering load transfer plate positioner extending from the second side wall; wherein the load transfer plate and the load transfer plate pocket are configured and sized such that the load transfer plate can be positioned in the load transfer plate pocket beyond a center line of the load transfer plate.

In various such embodiments of the load transfer apparatus, the load transfer plate defines an interior edge that defines a slab attachment opening.

In various such embodiments of the load transfer apparatus, the load transfer plate includes at least one stress reducing outer edge.

It should further be appreciated from the above that in various embodiments, the present disclosure provides a load transfer apparatus for transferring loads across a joint between a first cast-in-place concrete slab and a second cast-in-place concrete slab, the load transfer apparatus comprising: (A) a load transfer plate including a generally diamond shaped body having: (a) a substantially planar upper surface; and (b) a substantially planar lower surface; said generally diamond shaped body having: (i) a substantially tapered first portion; and (ii) a substantially tapered second portion configured to protrude into and be secured in the second cast-in-place concrete slab; and (B) a load transfer plate pocket configured to receive the load transfer plate, the load transfer plate pocket including: an attachment wall defining a load transfer plate receiving slot; and a body extending from the attachment wall, the body including: (a) an upper wall; (b) a lower wall, said lower wall spaced apart from the upper wall such that the load transfer plate can freely move between the lower wall and the upper wall; (c) a first side wall extending from the attachment wall and connected to the upper wall and to the lower wall; (d) a second side wall extending from the attachment wall and connected to the upper wall and to the lower wall; wherein the load transfer plate pocket is configured and sized such that: the load transfer plate can be positioned in the load transfer plate pocket beyond a center line of the load transfer plate.

In various such embodiments of the load transfer apparatus, the load transfer plate defines an interior edge that defines a slab attachment opening.

In various such embodiments of the load transfer apparatus, the load transfer plate includes at least one stress reducing outer edge.

It should further be appreciated from the above that in various embodiments, the present disclosure provides a method of for transferring loads across a joint between a first concrete slab and a second concrete slab, said method comprising: (a) placing an edge form on a ground surface; (b) attaching a load transfer plate pocket to the edge form such that part of the load transfer plate pocket extends into a first area where the first concrete slab will be formed; (c) pouring concrete material which forms the first concrete slab; (d) allowing the first concrete slab to partially cure; (e)

removing the edge form from the first concrete slab such that the load transfer plate pocket remains at least partially within and attached to the first concrete slab; (f) inserting a first half of the load transfer plate into the load transfer plate pocket and a first portion of a second half of the load transfer plate into the load transfer plate pocket, such that a second portion of the second half of the load transfer plate protrudes into a second area where the second concrete slab will be formed; (g) pouring concrete material that forms the second concrete slab into the second area where the second concrete slab will be formed; and (h) allowing the second concrete slab to cure.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving slot; and a generally triangular shaped body extending from the attachment wall, the body including:

(a) a generally triangular upper wall;

(b) a generally triangular lower wall, said lower wall spaced apart from the upper wall such that the load transfer plate can freely move between the lower wall and the upper wall;

(c) a first side wall connected to the upper wall and to the lower wall;

(d) a second side wall connected to the upper wall and to the lower wall;

(e) a first load transfer plate positioner extending from the first side wall;

(f) a second load transfer plate positioner extending from the second side wall;

(g) a centering third load transfer plate positioner extending from the first side wall and configured to engage a first tip of the load transfer plate that partially defines a widest area of the load transfer plate; and (h) a centering fourth load transfer plate positioner extending from the second side wall and configured to engage a second tip of the load transfer plate that partially defines the widest area of the load transfer plate, wherein the generally triangular shaped body is configured and sized such that the load transfer plate is positionable in the load transfer plate pocket beyond a center line of the load transfer plate when the centering third load transfer plate positioner and the centering fourth load transfer plate positioner engage the first and second tips of the load transfer plate.

2. The load transfer plate pocket of claim 1, which includes:

(i) a fifth load transfer plate positioner extending from the first side wall; and (j) a sixth load transfer plate positioner extending from the second side wall.

3. The load transfer plate pocket of claim 1, which includes:

(i) a first load transfer plate engager connected to the first load transfer plate positioner; and (j) a second load transfer plate engager connected to the second load transfer plate positioner.

4. The load transfer plate pocket of claim 3, wherein the first load transfer plate engager is connected to the second load transfer plate engager.

5. The load transfer plate pocket of claim 3, wherein the first load transfer plate engager is connected to the second load transfer plate engager at a substantially perpendicular angle.

6. The load transfer plate pocket of claim 3, wherein the first load transfer plate engager extends substantially parallel to the first side wall.

7. The load transfer plate pocket of claim 6, wherein the second load transfer plate engager extends substantially parallel to the second side wall.

8. The load transfer plate pocket of claim 3, wherein the first load transfer plate engager is configured to engage a first side edge of the load transfer plate.

9. The load transfer plate pocket of claim 8, wherein the second load transfer plate engager is configured to engage a second side edge of the load transfer plate.

10. The load transfer plate pocket of claim 1, wherein the generally triangular shaped body is configured and sized such that the load transfer plate is positionable in the load transfer plate pocket beyond the widest area of the load transfer plate at installation.

11. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving slot; and a generally triangular shaped body extending from the attachment wall, the body including:

(a) a generally triangular upper wall;

(b) a generally triangular lower wall, said lower wall spaced apart from the upper wall such that the load transfer plate can freely move between the lower wall and the upper wall;

(c) a first side wall connected to the upper wall and to the lower wall;

(d) a second side wall connected to the upper wall and to the lower wall;

(e) a first centering load transfer plate positioner extending from the first side wall and configured to engage the load transfer plate adjacent to a first tip of the load transfer plate that partially defines a widest area of the load transfer plate; and (f) a second centering load transfer plate positioner extending from the second side wall and configured to engage the load transfer plate adjacent to a second tip of the load transfer plate that partially defines the widest area of the load transfer plate.

12. The load transfer plate pocket of claim 11, which includes:

(e) a first load transfer plate positioner extending from the first side wall; and (f) a second load transfer plate positioner extending from the second side wall.

13. The load transfer plate pocket of claim 11, wherein the generally triangular shaped body is configured and sized such that the load transfer plate is positionable in the load transfer plate pocket beyond the widest area of the load transfer plate at installation.

* * * * *